US007798734B2

(12) United States Patent
Karaki et al.

(10) Patent No.: US 7,798,734 B2
(45) **Date of Patent: *Sep. 21, 2010**

(54) PRINTING DEVICE

(75) Inventors: Nobuo Karaki, Matsumot (JP); Shoichi Nagao, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/007,107

(22) Filed: Jan. 7, 2008

(65) Prior Publication Data

US 2008/0118294 A1 May 22, 2008

Related U.S. Application Data

(63) Continuation of application No. 11/166,154, filed on Jun. 27, 2005, now Pat. No. 7,377,705.

(30) Foreign Application Priority Data

Aug. 4, 2004 (JP) ..... 2004-227497

(51) Int. Cl.
*B41J 19/00* (2006.01)

(52) U.S. Cl. ..... 400/283; 400/185; 400/187; 400/317; 400/317.2

(58) Field of Classification Search ..... 400/283, 400/186, 187, 183, 317, 317.2
See application file for complete search history.

(56) References Cited

U.S. PATENT DOCUMENTS 4,161,912 A * 7/1979 Usui et al. ..... 101/99
4,386,863 A 6/1983 Rooney
4,941,405 A 7/1990 Helms
5,406,216 A 4/1995 Milman et al.
5,456,128 A 10/1995 Thunker
5,530,790 A * 6/1996 Ueyama ..... 358/1.2
5,534,909 A * 7/1996 Hanabusa et al. ..... 347/216
5,630,155 A * 5/1997 Karaki et al. ..... 713/340
5,674,016 A 10/1997 Kimura et al.
6,050,674 A 4/2000 Hirabayashi et al.
6,793,316 B2 9/2004 Sugimura et al.
7,377,705 B2 * 5/2008 Karaki et al. ..... 400/283

FOREIGN PATENT DOCUMENTS

JP A-57-93175 6/1982
JP U-03-045147 4/1991
JP 04-340118 A 11/1992
JP A-6-94850 4/1994
JP A-7-202645 8/1995
JP A-08-039885 2/1996
JP A-10-100490 4/1998
JP A-2003-260847 9/2003
JP A-2004-066602 3/2004

* cited by examiner

*Primary Examiner*—Ren Yan
*Assistant Examiner*—Matthew G Marini
(74) *Attorney, Agent, or Firm*—Oliff & Berridge, PLC

(57) ABSTRACT

A printing device, including: a mechanical energy storage mechanism for storing mechanical energy; and a mechanical energy application mechanism for carrying a sheet and/or printing on the sheet, using the mechanical energy stored.

10 Claims, 16 Drawing Sheets

PRINTING DEVICE

This is a Continuation of application Ser. No. 11/166,154 filed Jun. 27, 2005. The disclosure of the prior application is incorporated herein by reference in its entirety.

BACKGROUND

The present invention relates to a printing device used independently, or as a terminal device connected to a computer etc., specifically to a printing device that does not require a commercial power supply or a charged battery as a power source.

It has been common practice to utilize electric energy provided externally as a power source in a printing device. For example, printing devices have been used as a stationary printer utilizing the commercial power supplied to a power source outlet, or as a mobile printer utilizing a charger so as to charge a built-in battery from the commercial power source. Mobile computers that are capable of continuous usage in locations, where for example a commercial power is not available, have been available. This technology is described, for instance, in Japanese Patent Application Publication No. 4-340118. However, no related art is available for a printing device.

The age of mobile computing has arrived and the demand for printing, away in the field or a remote site, has increased. However, with the above-mentioned printing devices, printing needs had to be given up, if there is no power source outlet that enables to utilize the commercial power source available at the destination, or if the supply of spare batteries is in short.

SUMMARY

The advantage of the invention is to provide a printing device that enables printing by utilizing mechanical energy, without utilizing an external power source.

According to an aspect of the invention, a printing device includes: a mechanical energy storage mechanism for storing mechanical energy; and a mechanical energy application mechanism for carrying a sheet and/or printing on the sheet, using the mechanical energy stored.

With the above-mentioned configuration, the mechanical energy, more specifically the mechanical energy provided by an operation from the user or by a pressure of gas etc., is stored. Further, by utilizing this stored mechanical energy, the sheet is carried or printed thereon. Hence the objective of printing can be achieved readily and anywhere.

Here, the "sheet" generally includes any paper medium such as regular paper, quality paper, and special paper. However, the "paper" should not be limited to those media, and may include approximately anything which can be a target for printing, for example a plastic thin film or a metallic thin film etc. These should fall under the category of "sheet". Flexibility is not a necessity for the "sheet", depending on the structure of the printing device. If its structure enables printing on a print surface with high degree of hardness, for example a wall surface, the wall surface can also be grasped as the "sheet" in the invention. In this case, "to carry" or "carrying" includes modification and control of relative location between a print surface and a part that conducts printing.

Here, directions for carrying the sheet include two cases: configuring the mechanism to carry the sheet unidirectionally, or configuring the mechanism to carry the sheet in different directions for storing and releasing of the mechanical energy.

More specifically, according to another aspect of the invention, a printing device includes: a mechanical energy storage mechanism for storing mechanical energy provided from an external part; a sheet carrying mechanism for carrying a sheet by the mechanical energy; a head carrying mechanism for carrying a print head by the mechanical energy; an electric energy conversion mechanism for converting the mechanical energy into electric energy; an electric energy storage device for storing the electric energy converted by the electric energy conversion mechanism; a mechanical system controlling device for controlling a carrying of the sheet by the sheet carrying mechanism and/or a carrying of the print head by the head carrying mechanism, being operated by the electric energy; a print-controlling device for controlling printing on the sheet with the print head based on print-information, being operated by the electric energy.

With the above-mentioned configuration, the mechanical energy is stored upon being supplied from an external part. The sheet carrying mechanism carries (drives) the sheet by this mechanical energy. The head carrying mechanism carries (drives) the print head by this mechanical energy. The electric energy conversion mechanism converts the mechanical energy into electric energy by mechanic-electric energy conversion. The electric energy storage device stores this electric energy. The mechanical system controlling device operates by this electric energy, and controls the carrying of the sheet or the print head. The print-controlling device also operates by this electric energy and controls printing on the sheet with reference to print-information. The physical moving, carrying, or driving of the sheet and the print head is attained by the mechanical energy, and their control is achieved by the electric energy converted from the mechanical energy.

Here, a method for transmitting the mechanical energy to the mechanical energy storage mechanism may include a configuration that enables the transmission of the power provided with an operation by a user to the mechanical energy storage mechanism. In this configuration, the power provided by the user with the user's operation, for example power to rotate a handle or power to operate a lever, is mechanically transmitted to the mechanical energy storage mechanism; hence with such configuration, the storage of the energy can be attained without using an external power source.

Moreover, another case of transmitting the mechanical energy to the mechanical energy storage mechanism may include a configuration that enables a transmission of power provided by a pressure of a compressed gas into the mechanical energy storage mechanism. There are several possible embodiments for attaining such case. For example, the configuration may include a canister in which the compressed gas is filled, so that the power provided by the pressure of the compressed gas can be transmitted to the energy storage mechanism. In this configuration, the mechanical power is stored in a way that the power provided by the pressure of the compressed gas is transmitted to the mechanical energy storage mechanism; hence with such configuration, the storage of the energy can be attained without using an external power source.

Here, the mechanical energy storage mechanism stores an elastic energy as the mechanical energy. The elastic energy is a kind of energy that is stored within a solid object when it changes its shape. Mechanisms that utilize the elastic deformation may include a mechanism with elastic bodies such as a mainspring, a spring, rubber or the like. Specifically, the mainspring mechanism is suitable, since, being generically used as a means to store the mechanical energy, it can be utilized with low cost, and can store a large amount of mechanical energy for a long duration. The spring and the rubber can also be utilized with low cost; hence they are suitable for printing devices for toys, for example.

Further, another case of storing the mechanical energy to the mechanical energy storage mechanism may include the storing of the internal energy of gas. In the first law of thermodynamics, the internal energy of gas is regulated by pressure and cubic volume in a fixed temperature. In the case of utilizing the internal energy of gas, a cylinder configured to enable a filling of gas, and a mechanism that releases the pressure of gas filled into the cylinder as mechanical energy, may be provided. In this configuration, the gas is compressed as it is filled into the cylinder, and the power corresponding to the pressure is generated. Upon releasing the power provided by the pressure of the compressed gas, this power is extracted as mechanical power, functioning as a sort of a mechanical energy storage mechanism.

Here, the electric energy conversion mechanism is configured to enable the conversion of the mechanical energy, which is provided when the mechanical energy is being released from the stored mechanical energy in the mechanical energy storage mechanism, into the electric energy. This configuration first stores the external power to the mechanical energy storage mechanism, and thereafter converts the stored mechanical energy to the electric energy.

On the other hand, the electric energy conversion mechanism may be configured to be able to convert part of the mechanical energy into the electric energy, upon storing the mechanical energy to the mechanical energy storage mechanism. This configuration performs conversion of the external power into the electric energy while storing it to the mechanical energy storage mechanism in parallel.

Further, the above-mentioned case may further include a location detector for detecting the location of the sheet and the print head; wherein the printing device is configured to control the carrying of the sheet, the carrying of the print head, and/or the print head to print, based on the print-information, with reference to the detected locations of the sheet and/or the head. In this configuration, when the location of the sheet or the print head is detected, it is possible to: control the carrying of the sheet by the sheet carrying mechanism, control the carrying of the print head by the head carrying mechanism, and to control the printing on the sheet based on the print-information by the print-controlling device.

Here, the print-controlling device may be configured to have an ability to utilize one or more pieces of information selected from: information sent from the external part, information stored in a storage device, information stored in a detachable storage medium, and operational information input from an input device. With this configuration, it is possible to: input the information sent, for example, from an external computer device etc., to the printing device, and print accordingly; print based on the information stored in the detachable storage medium; and to print based on the operational information input from the input device.

Here, the "detachable storage medium" may include various storage media, such as disk media (FD, MD, CD-ROM, DVD-ROM) and memory type media (a memory stick, an IC card or the like).

The print-controlling device may include a converter that converts the operational information input from the input device into printing data which represents a prescribed graphic or character. With this configuration, it is possible to: print a corresponding graphic or character by decoding the operational information, if the operational information corresponds to one graphic or character; or present the graphic or character(s) corresponding to the operation, where the prescribed graphic or character(s) are registered in advance in correspondence to the contents of operations.

Here, it is preferable that at least one among the mechanical system controlling device and the print-controlling device is configured with an asynchronous circuit. With the asynchronous circuit, the system operates in an event-driven fashion without using a clock, so that only necessary actions are conducted when they are necessary, during which time the electricity is consumed. This system is optimal to this printing device in which the electric energy needs to be limited as much as possible.

According to a further aspect of the invention, a printing device for printing on a sheet includes: a mechanical energy storage mechanism for storing mechanical energy provided by an operation of a user; a restriction mechanism for restricting release of the mechanical energy stored in the mechanical energy storage mechanism; a sheet carrying mechanism for carrying the sheet by the mechanical energy released from the mechanical energy storage mechanism, if restriction by the restriction mechanism is disengaged; a head carrying mechanism for carrying a print head by the mechanical energy released from the mechanical energy storage mechanism; an electric energy conversion mechanism for converting the mechanical energy, released from the mechanical energy storage mechanism, into electric energy; an electric energy storage device for storing the electric energy converted by the electric energy conversion mechanism; a mechanical system controlling device for controlling a carrying of the sheet by the sheet carrying mechanism and/or a carrying of the print head by the head carrying mechanism, being operated by the electric energy stored in the electric energy storage device; and a print-controlling device for controlling printing on the sheet with the print head based on print-information, being operated by the electric energy stored in the electric energy storage device.

In this case, the printing device may include: an alternating restriction mechanism, in which restriction and disengagement is repeated alternately between the sheet carrying mechanism and the head carrying mechanism; wherein in the sheet carrying mechanism, the carrying of the sheet is configured to be: disengaged of its restriction if the print head reaches a prescribed location by the head carrying mechanism, and restricted after the sheet is carried for a prescribed amount; and wherein in the head carrying mechanism, the carrying of the print head is configured to be: disengaged of its restriction in the width direction of the sheet, if the sheet is carried to a prescribed location by the sheet carrying mechanism, and restricted after the print head is carried one sheet width. With this configuration, the carrying of the sheet and the print head are performed alternately; thus electrical aids for controlling both the line feed and the sheet feed for each line feed are not necessary, enabling to complete the carrying of the sheet and the print head only by the mechanical energy. Therefore the significant electric energy is spent on print-control, allowing power saving, thereby enabling to conduct printing for a long duration in one mechanical energy storage.

Here, a ratchet mechanism, configured to be able to fix itself temporarily with a restrictor lever, is provided, with which a restriction and a release of the mechanical energy, stored in the mechanical energy storage mechanism, are conducted. With this configuration, the stored mechanical energy is released by either the disengagement of the ratchet mechanism, or the energy is retained by the restriction of the ratchet mechanism; thus it is possible to vary the timings of storing the mechanical energy or printing by releasing the mechanical energy. Hence, as long as the mechanical energy is stored, it is possible to perform printing of as many pages as required, anytime.

BRIEF DESCRIPTION OF THE DRAWINGS

The invention will be described with reference to the accompanying drawings, wherein like numbers refer to like elements, and wherein.

DETAILED DESCRIPTION OF EMBODIMENTS

Embodiments of the invention will now be described with reference to drawings. The embodiment of the invention described hereafter is a printing device that includes means to store mechanical energy and means to carry the sheet (paper) and to print onto the sheet using the stored mechanical energy. Each embodiment is simply an example of the invention; therefore the present invention shall not be limited to the embodiments mentioned hereafter, and can be applied with other kinds of modifications.

Embodiment 1

Figure 1:
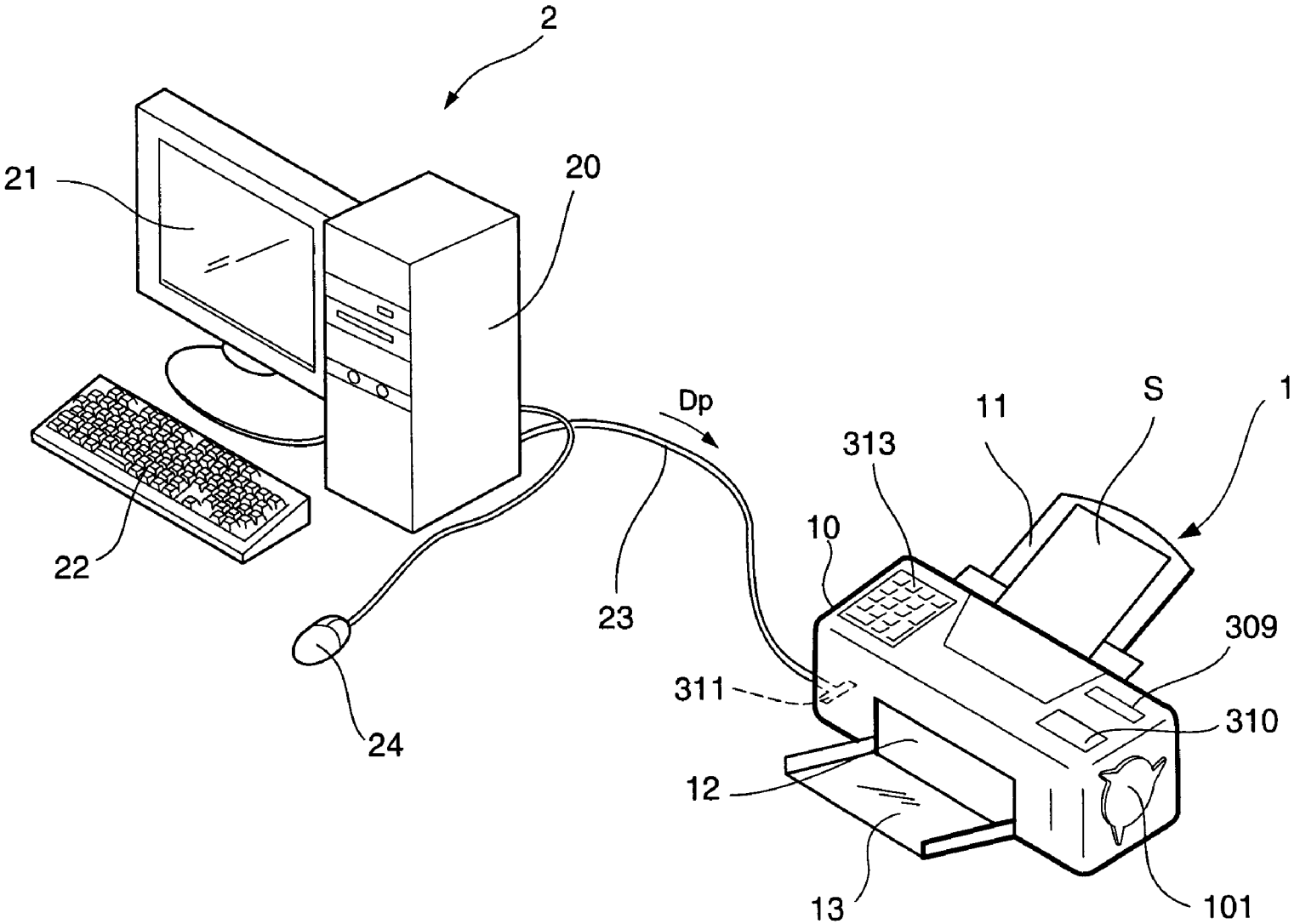
FIG. 1 is a conceptual drawing of a system for a printing device in Embodiment 1.

In FIG. 1, an explanatory drawing of the system configuration, including a printing device in embodiment 1, is shown. Embodiment 1 specifically relates to the printing device configured to carry the sheet unidirectionally. In FIG. 1, a printing device 1 according to Embodiment 1, and a computer device 2 that sends print-information Dp to the printing device 1, are shown.

Figure 9:
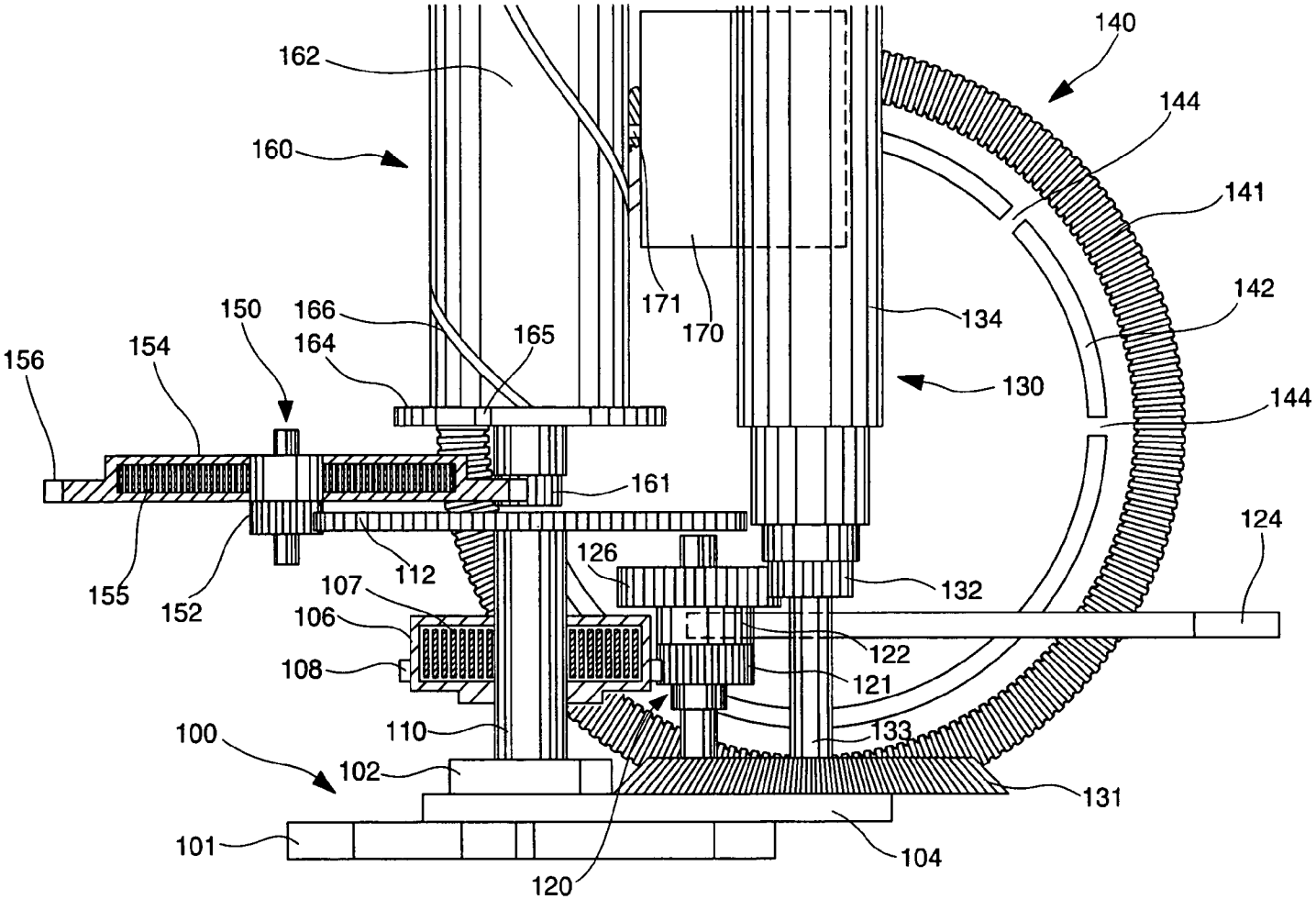
FIG. 9 is a conceptual side view drawing of the mechanical parts in Embodiment 1.

The printing device 1, from the outlook, has a body 10 whereon a sheet feeder 11, on which a sheet S is placed, is installed. A vent 12 opens when a sheet tray 13 unfolds itself. The body 10 is provided with: a slot 309 for plugging a removable disk, which is a detachable storage medium, in and out; a display 310 for displaying a prescribed character or a graphic; a connector 311, to which a connecting cable 23 is connected, for receiving the print-information Dp being sent from the computer device 2; and an input device 313 for inputting operational information to a control unit 300 (not shown, refer to FIG. 9). Moreover, on the side surface of the body 10, a handle 101 that is turned by a user for providing the mechanical energy to the mechanical energy storage mechanism in the embodiment of the invention, is installed in a way that it can rotate.

The computer device 2 is provided with a configuration as a generic personal computer, and includes a computer body 20, a liquid crystal display 21, a keyboard 22, and a mouse 24, etc. Behind the computer body 20, the connecting cable 23 is connected to a printer connector (not shown), so as to send print-information (including information related to characters or graphics that will be printed, as well as print-controlling information) generated by the computer device 2 to the printing device 1.

Figure 2:
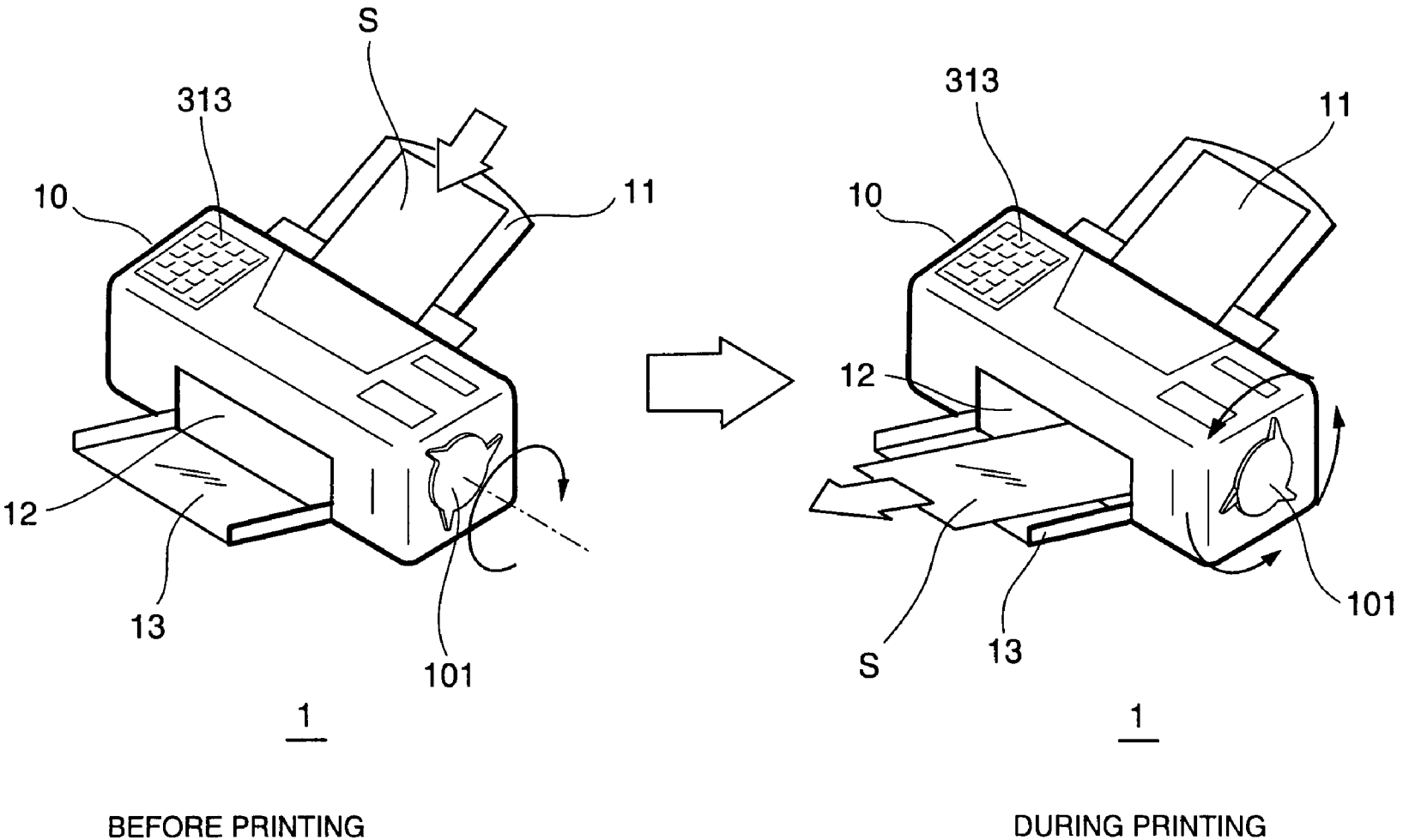
FIG. 2 is an explanatory drawing, showing a direction for carrying of the sheet in the printing device in Embodiment 1.

In FIG. 2, the direction for carrying the sheet S in the printing device 1 in Embodiment 1 is shown. As shown in FIG. 2, the printing device 1 is configured so that prior to printing, the user rotates the handle 101 in the direction indicated by an arrow, and the power therein is stored as mechanical energy inside the device. At the start of printing, print-start is instructed by operating the input device 313; thereafter the sheet S placed on the sheet feeder 11 is carried and rolled in to the direction of the outlined arrow. During the printing, the printing device 1 operates so as to carry the sheet S to the same direction to that of roll-in, utilizing the mechanical energy stored within, and to vent the printed sheet S through the vent 12. At this point, the handle 101 rotates in the opposite direction to that of when the mechanical energy is being stored, and the mechanical energy is released.

Block Configuration of Features

Figure 3:
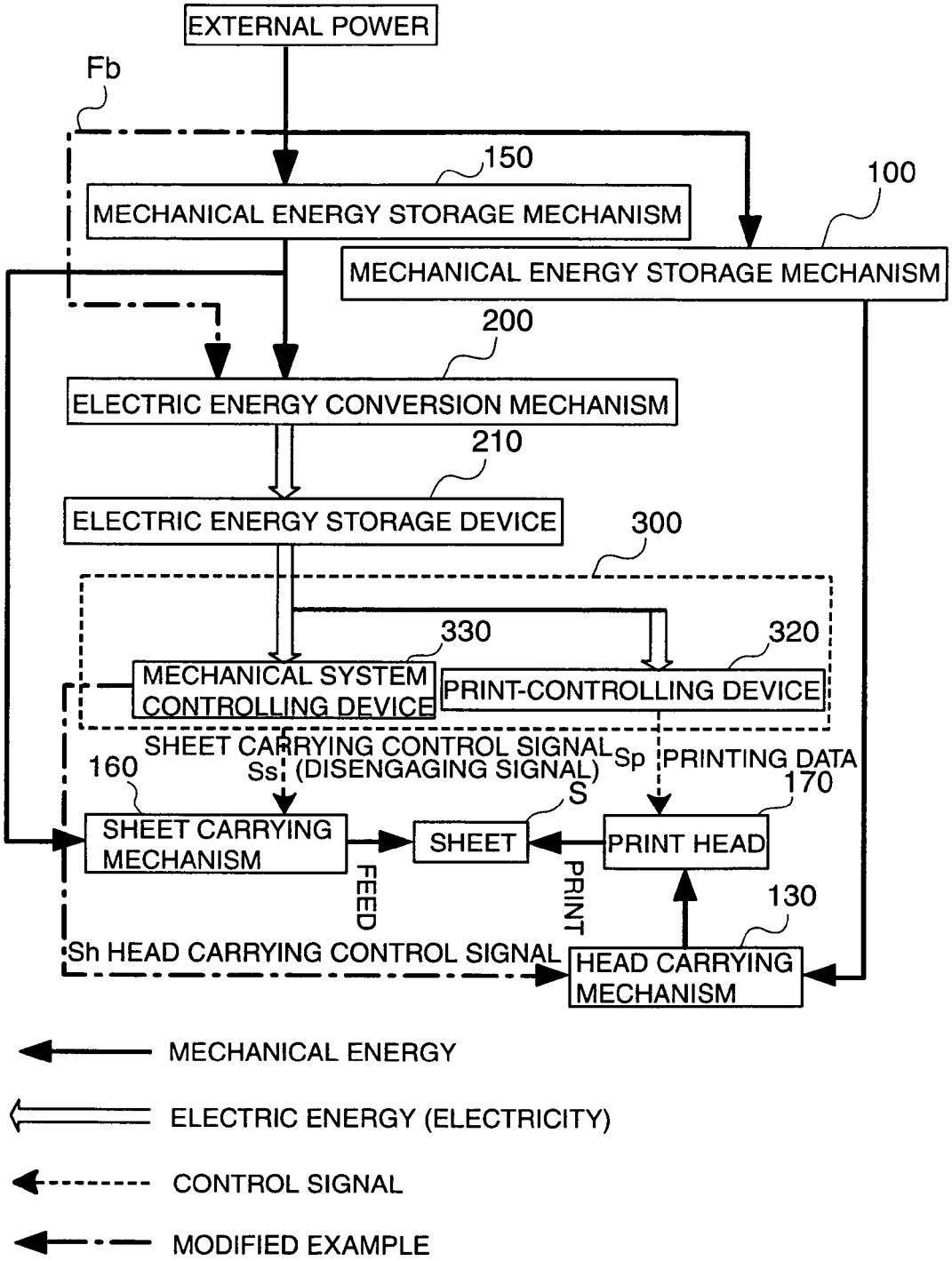
FIG. 3 is a drawing of block configuration in embodiments of the invention.

In FIG. 3, a block configuration of features in the printing device 1 in the embodiments of the invention is shown. In FIG. 3, arrows with solid line indicate flows of the mechanical energy, outlined arrows indicate flows of the electric energy, and the arrows with dotted line indicate flows of control signals. Moreover, arrows with dashed line indicate modified examples of Embodiment 1.

As shown in FIG. 3, the printing device 1 includes: mechanical energy storage mechanisms 100 and 150 for storing the mechanical energy provided externally (an external power); a sheet carrying mechanism 130 for carrying the sheet S by the mechanical energy; a head carrying mechanism 160 for carrying a print head 170 by the mechanical energy; an electric energy conversion mechanism 200 for converting the mechanical energy into electric energy; an electric energy storage device 210 for storing the electric energy converted by the electric energy conversion mechanism 200; a mechanical system controlling device 330 for controlling the carrying of the sheet by the sheet carrying mechanism 130 and/or the carrying of the print head 170 by the head carrying mechanism 160, being operated by the electric energy; a print-controlling device 320 for controlling printing on the sheet S with the print head 170 based on printing data Sp, being operated by the electric energy. The detailed configuration of components is described in FIG. 6.

In Embodiment 1, a method for transmitting the mechanical energy to the mechanical energy storage mechanisms 100 and 150 includes a configuration that enables the transmission of the power as the external power, which is supplied with an operation of the handle 101 by the user, to the mechanical energy storage mechanisms 100 and 150.

In the embodiments, there are two mechanical energy storage mechanisms 100 and 150, utilized as the mechanical energy storage mechanism. The mechanical energy storage mechanism 100 is provided so that the mechanical energy can be transmitted mainly to the head carrying mechanism 160, and the mechanical energy storage mechanism 150 is provided so that the mechanical energy can mainly be both converted to the electric energy and transmitted to the sheet carrying mechanism. If an output (storage capacity) of the mechanical energy is large, then naturally only one mechanical energy storage mechanism may be installed. Contrarily, depending on the level of required mechanical energy, 3 or more of the mechanical energy storage mechanisms may also be installed.

Here in Embodiment 1, a mainspring mechanism utilizing the elastic energy is included for the mechanical energy storage mechanisms 100 and 150. The mainspring mechanism is suitable, since, being generically used as a means to store the mechanical energy, it can be utilized with low cost, and can store a large amount of mechanical energy for a long duration. A mainspring is a strip of metallic flat strand wound up in spiral. Increasing the level of winding from the loosened status generates torque, and the mechanical energy corresponding to its strength is preserved. A width and a thickness of a mainspring strongly affect the torque generated by the mainspring. For example, twice the width generates twice as much torque, while twice the thickness generates eight times as much torque. Further, the longer the length of the mainspring is, the longer the duration of power retention at the time of release. According to the amount of torque and the duration required, the mainspring with appropriate width and length is selected. The stronger the torque is, the more mechanical energy is generated, enabling to activate many mechanical components, while the endurance tends to decrease since strong friction is generated at the same time. In general, it is desirable to design a system with torque decreased as much as possible, so that a gear train friction is decreased in order for the gear train to operate with the week torque. The mainspring is contained inside a box called a barrel. The mainspring, when taken out from the barrel and its constraint being released, has an S-shape, so that power received at each part of the mainspring is even. The inner end of the mainspring is fixed to a shaft called a barrel axis, and its outer end is hooked to the inner wall of the barrel in turnup. The mainspring may be made of various kinds of materials; however, the alloyed mainspring is optimal due to its high elastic limit. For example, mainsprings with the trade names "Isoflex" and "Nivalex" etc, are known.

The electric energy conversion mechanism 200 needs to be provided with a structure to enable the conversion of the mechanical energy into the electric energy. In the embodiments, it is structured as a generator. In Embodiment 1, it is configured so that the mechanical energy provided as the external power is first stored in the mechanical energy storage mechanism 150, and thereafter converted into the electric energy, when the stored mechanical energy is being released.

However, as shown in a modified example Fb in FIG. 3, it may also be configured to convert part of the mechanical energy into the electric energy while storing it in parallel to the mechanical energy storage mechanism 150. Moreover, the electric energy conversion mechanism may also be configured to enable the conversion of the mechanical energy into the electric energy, at both times during the time when the external power is being supplied and during the time when the mechanical energy is being released from the stored mechanical energy in the mechanical energy storage mechanism 150.

The electric energy storage device 210 is configured to enable the storage of the electric energy generated by the conversion of the mechanical energy in the electric energy conversion mechanism 200. There is no specific limitation for its application; however, in Embodiment 1, a battery is used. Alternatively, using high-capacity condenser as a battery may also be inexpensive and suitable. The battery used here is a rechargeable secondary battery. The variations of batteries available for it includes: lead battery, Ni—Cd battery, Ni—Cd alkaline battery, nickel hydride battery, Mg—Li battery, lithium battery, etc.

Figure 4:
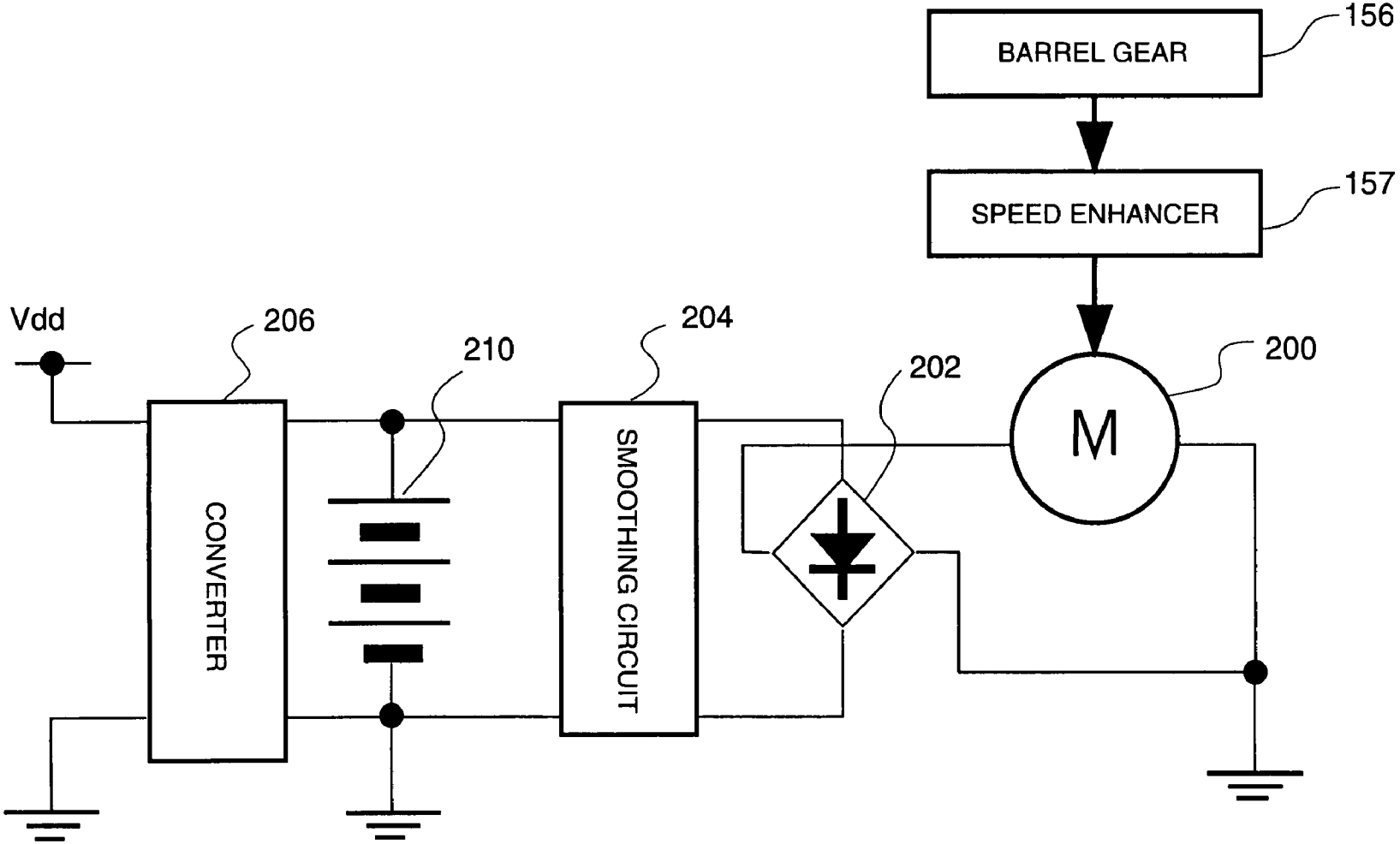
FIG. 4 is a drawing of a surrounding configuration for a mechanical-to-electric energy conversion mechanism in the embodiments of the invention.

In FIG. 4, details of the surrounding configuration including the electric energy conversion mechanism 200 and the electric energy storage device 210 are shown. As shown in FIG. 4, the electric energy conversion mechanism 200 (hereafter also referred to as "generator 200") has a configuration of so-called alternating-current generator, and the electric energy storage device 210 (hereafter also referred to as "battery 210") is a battery. From a barrel gear 156, which is a point of origin in releasing the mechanical energy from the mechanical energy storage mechanism 150, turning force is conveyed to the generator 200 with appropriate rotation speed, through a speed enhancer 157 that includes a gear train that generates a suitable rotation speed for power generation. An alternating current generated by this generator 200 is converted to a pulsating current with a rectifier 202, wherein a smoothing circuit 204 removes a ripple. Consequently the pulsating current becomes a direct current, which will be charged into the battery 210. The electric energy stored in the battery 210, in other words the electricity, is converted to an operational voltage (5V for example) suitable for the operation of the control unit 300 by a DC-DC converter 206, and is output as a power source Vdd.

Figure 5:
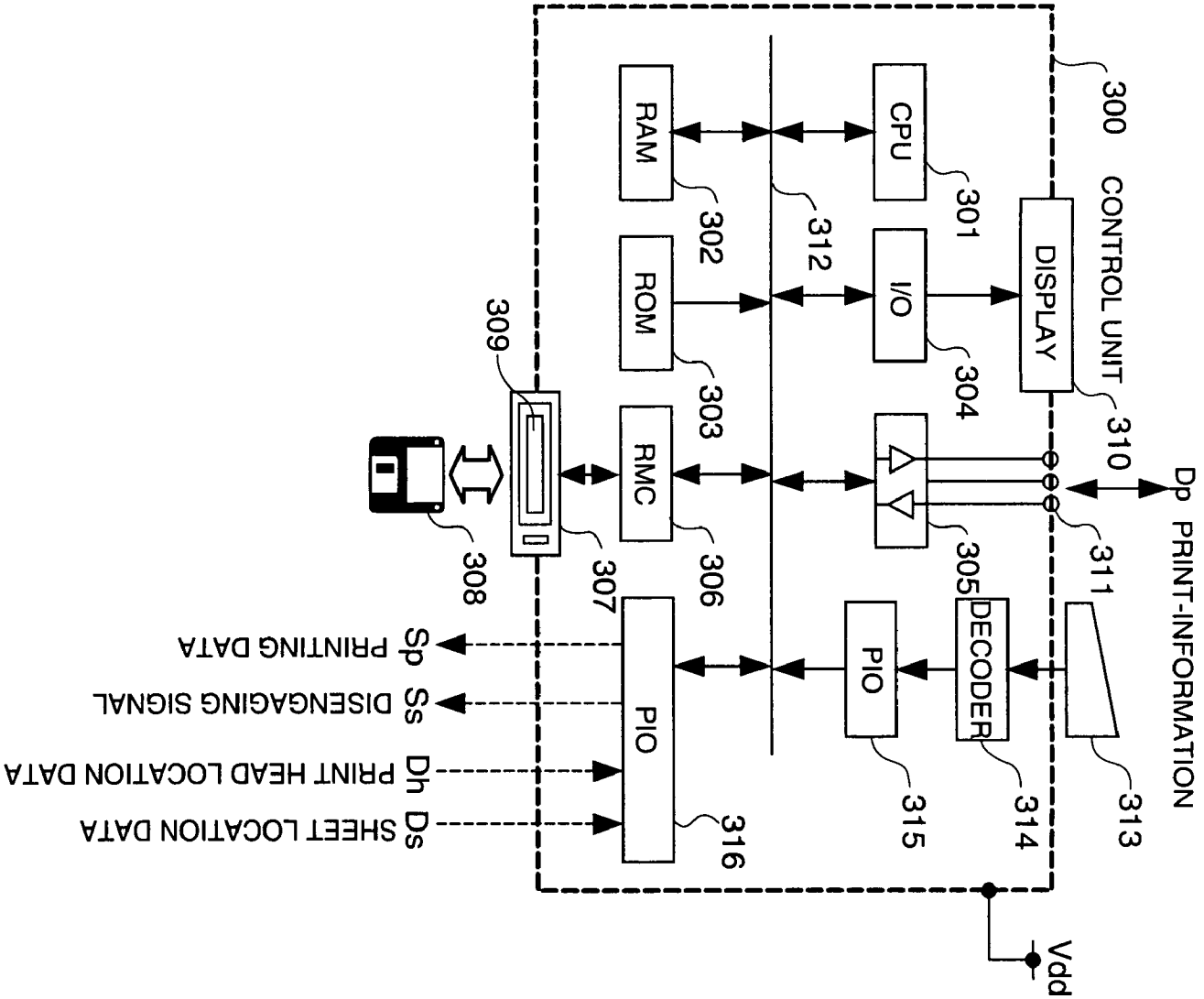
FIG. 5 is a block drawing of a control unit in the embodiments of the invention.

In FIG. 5, a specific block diagram of the control unit 300 in Embodiment 1 is shown. The control unit 300 includes: a CPU 301, a RAM 302, a ROM 303, an interface circuit 304, a transceiver 305, a removable media control (RMC) circuit 306, a storage media driving unit 307, a detachable storage medium 308, a slot 309, a parallel interface device 316, a connector 311, an internal bus 312, an input device 313, a decoder 314, and a parallel interface device 315.

The control unit 300 is a computer device that operates with the power source Vdd, which is the electric energy converted from the mechanical energy. The CPU 301 sequentially runs a software program stored in the ROM 303, controls the entire system to fit to the prescribed objectives, and operates the control unit 300 to function as the mechanical system controlling device 330 and the print-controlling device 320. The RAM 302 is utilized by the CPU 301 as its primary storage space, and stores the print-information Dp sent from the external unit (the computer device 2) or a print-information read out from the storage medium 308. The interface circuit 304 performs a display of information that corresponds to the status of the printing device 1 or to the input device, an indication of the print-information, or instructions to the user, etc., on the display 310 for the user to be able to recognize. The transceiver 305 is connected to the connector 311, and is able to receive the print-information Dp sent from the computer device 2 (see FIG. 1), as well as to send a request signal of the printing device 1 toward the computer device 2. The storage media driving unit 307 conducts a read-in and read-out of stored information, in compliance with the format of the storage medium 308 utilized in the printing device 1. For example, if the storage medium 308 is a disk medium such as a FD, an MD, a CD-ROM, a DVD-ROM, etc., then the storage media driving unit 307 serves as a disk driving device, which is configured to enable a read-out of the information from respective storage medium. If the storage medium 308 is a memory card type medium such as a flash card, a memory stick, a smart card, an IC card, etc., then the storage media driving unit 307 serves as an interface circuit that can connect those media and distribute data to the internal bus 312. The parallel interface device 316 receives sheet location data Ds or print head location data Dh detected on demand, and distributes the data to the internal bus 312. It also outputs a sheet carrying control signal (hereafter "disengaging signal Ss" in the embodiments) or a head carrying control signal Sh that are generated by the CPU 301, or outputs the printing data Sp transferred from the RAM 302, etc. The decoder 314 parses the operational information input by the user's operation from the input device 313 installed on the body 10, and distributes the generated code that corresponds with keystrokes to the internal bus 312 through the parallel interface device 315.

The control unit 300 may operate as a synchronous computer in which instructions are executed while setting timings with a base clock from a crystal resonator. However, specifically in Embodiment 1, it is organized as an asynchronous computer. An asynchronous computer is an event-driven computer, and is designed to act asynchronously, corresponding to the change of external signals. The heart of this system, an asynchronous CPU, basically has a similar block configuration to a synchronous computer. For example, it is provided with a program counter, a memory address register that stores the address of an instruction to be executed subsequently, a memory data register that retains data read out from a memory being accessed, a instruction register that retains a currently executed instruction, a generic register which is a work area required for computing and processing, an arithmetic circuit, and a control circuit for the entire system. However, in an asynchronous CPU, each block's action is not governed by the base clock. Thus the asynchronous CPU relies on a Rendezvous circuit or an Arbiter circuit, which are special circuits that regulate the order of actions of each block, for local coordination, so that when end data arrives and a processing in one block is completed, a processing for another subsequent block starts. The Rendezvous circuit coordinates the actions of the asynchronous CPU, and controls the data so that it flows in sequential order without having a centrally controlled clock, using, for example, a Muller C-element. The Arbiter circuit conducts an arbitration processing, granting access to one of the actions when two blocks request to access a certain block at approximately the same time. Various common techniques that have been researched may be utilized for an asynchronous CPU. The overview of the technology is disclosed, for instance, in I. E. Sutherland et al, *Hidohki chip de genkai wo yabure* (*Exceeding limits with an asynchronous chip*), page 68 through 76 in Nikkei Science, November issue, 2002. It is desirable that the RAM 302, ROM 303 and other groups of interface circuits, operate with the asynchronous system. By utilizing the asynchronous computer, a current flows and power is consumed only for moments when the actions are necessary; hence it is possible to provide an extremely power saving system. This is suitable for circuit organization of a computer for the printing device in the embodiments of the invention, which utilizes the limited amount of electric energy converted from the mechanical energy.

Now, going back to the description of block configuration in FIG. 3, the mechanical system controlling device 330 can output, as described above, the sheet carrying control signal ("disengaging signal Ss" in the embodiments) that instructs the carrying of the sheet S. The sheet carrying mechanism 130 starts to operate if the restriction is disengaged by the disengaging signal Ss supplied from the mechanical system controlling device 330, for example if the restrictor lever 124 (described later in FIG. 6) is operated by an electromagnetic switch, and feeds the sheet S for the prescribed amount. The head carrying mechanism 160, its operation being coordinated with the sheet carrying mechanism 130, waits for the completion of the carrying of the sheet S for the prescribed amount, and carries the print head 170 to the width direction of the sheet (orthogonal to the feed direction). As will be described later, the carrying of the sheet S by the sheet carrying mechanism 130, and the carrying of the print head 170 by the head carrying mechanism 160 are restricted alternately, and are operated alternately.

The print-controlling device 320 supplies the printing data Sp to the print head 170 at the time of the carrying of the print head 170, and prints a graphic or a character that corresponds to the printing data Sp on the sheet S. Here, the print-controlling device 320 refers to the print head location data Dh, detected by a location detector (not shown), which indicates the location for carrying of the print head 170 in the width direction, and controls the timing for supplying the printing data Sp to the print head 170. In this configuration, the print-controlling device 320 is able to supply to the print head 170, print-information, such as: information sent from external parts, for instance the computer device 2 or the like, through the connector 311; information preliminarily stored in storage devices such as the RAM 302 or the ROM 303; information stored in a detachable storage medium 308; or operational information input from the input device 313. The print-controlling device 320 may include a conversion feature that converts the operational information input from the input device 313 into printing data that represents a prescribed graphic or character. With this configuration, it is possible to: print a corresponding graphic or character by decoding the operational information, if the operational information corresponds to one graphic or character; or present the graphic or character(s) corresponding to the operation, where the prescribed graphic or character(s) are registered in advance in correspondence with the contents of operations.

There is no specific limitation for the structure of the print head 170, except that the print head 170 should be installed on the carriage with exchangeability, which is carried by the head carrying mechanism 160. Its format may include, for instance: the inkjet method, the electrostatic discharge method, the droplet discharge type that discharges ink with the thermal expansion method or the like, the thermosensitive printing method, and dot impact type. The format for the print head may also include a form of laser printer, even though this system does not fall within the concept of "carrying of the print head", that transfers toner powders adhered on a drum with electrostatic power to the sheet S and affixes them. The printing data Sp supplied to such print head 170 is composed of a driving pulse, that are modified in designing in a various manner, depending on the specification of the print head 170, and image information, etc.

The sheet carrying mechanism 130 in Embodiment 1 does not require an electric control, since it performs all the instances of sheet feed (paper feed) that are conducted every time the print head 170 is carried, in coordination with mechanical components. Therefore, in Embodiment 1, the disengagement signal Ss that regulates the restriction and the disengagement of the mechanical operations is output. Needless to say, a modified example, in case of electrically controlling the timing of the paper feed per each reciprocation or one-way operation, or the amount of sheet feed, may include a configuration that can output the sheet carrying control signal that contains such controlling instructions.

In Embodiment 1, as described with reference to the block configuration of features in FIG. 3, the physical moving, carrying, or driving of the sheet and the print head is attained by the mechanical energy, and their control is achieved by having the electric energy converted from the mechanical energy as a power source.

Mechanical Configuration

Figure 6:
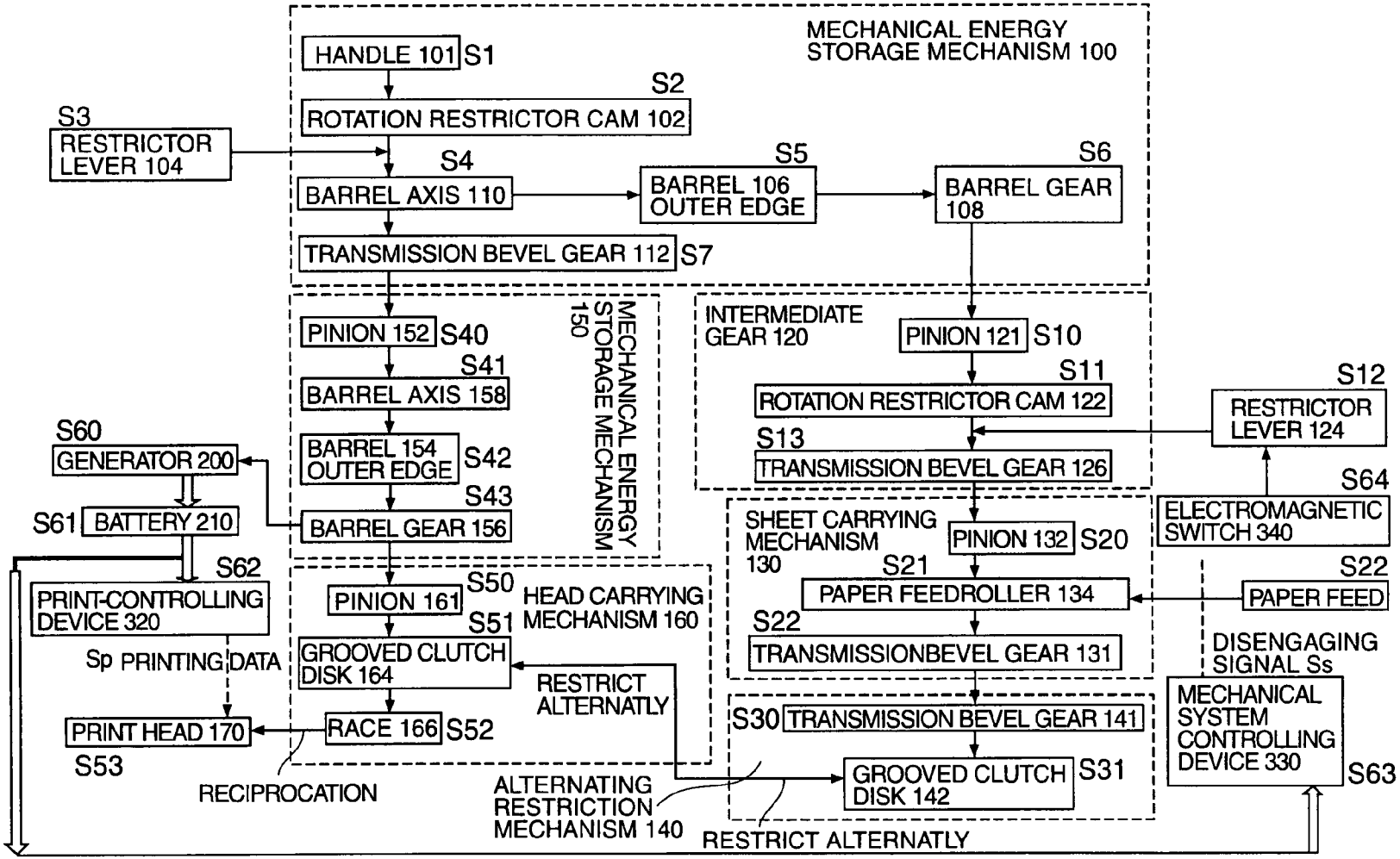
FIG. 6 is a drawing of operations of mechanical parts in Embodiment 1.

In FIG. 6, an explanatory drawing of the coordination relationship for specific mechanical components of the printing device 1 in Embodiment 1 is shown. The main part of these mechanical components is shown: as a conceptual oblique drawing in FIG. 7; as a conceptual top view drawing in FIG. 8; and as a conceptual side view drawing in FIG. 9.

As partly described in the above-mentioned block of features in FIG. 3, mechanisms of the printing device 1 are divided prominently into: the mechanical energy storage mechanisms 100 and 150, the head carrying mechanism 160, an intermediate gear 120, the sheet carrying mechanism 130, and an alternating restriction mechanism 140. The mechanical energy storage mechanisms 100 and 150 are mechanical parts that store the power added by the operation of the user as the mechanical energy. The head carrying mechanism 160 is a mechanical part, which moves the print head 170 together with the carriage, by the mechanical energy stored in the mechanical energy storage mechanism 150. The intermediate gear 120 is a gear train, which transmits the mechanical energy stored in the mechanical energy storage mechanism 100, to the sheet carrying mechanism 130, and is also a mechanical part that is restricted by the restrictor lever 124, i.e. the originating point of action. The sheet carrying mechanism 130 is a mechanical part that carries the sheet S with the mechanical energy transmitted from the intermediate gear 120. The alternating restriction mechanism 140 relates to the embodiments in the invention, and is a mechanical part that alternately performs the carrying of the print head 170 by the head carrying mechanism 160 and the carrying of the sheet S by the sheet carrying mechanism 130, as well as alternately restricting them. Hereafter, each mechanical part is described in detail.

Figure 7:
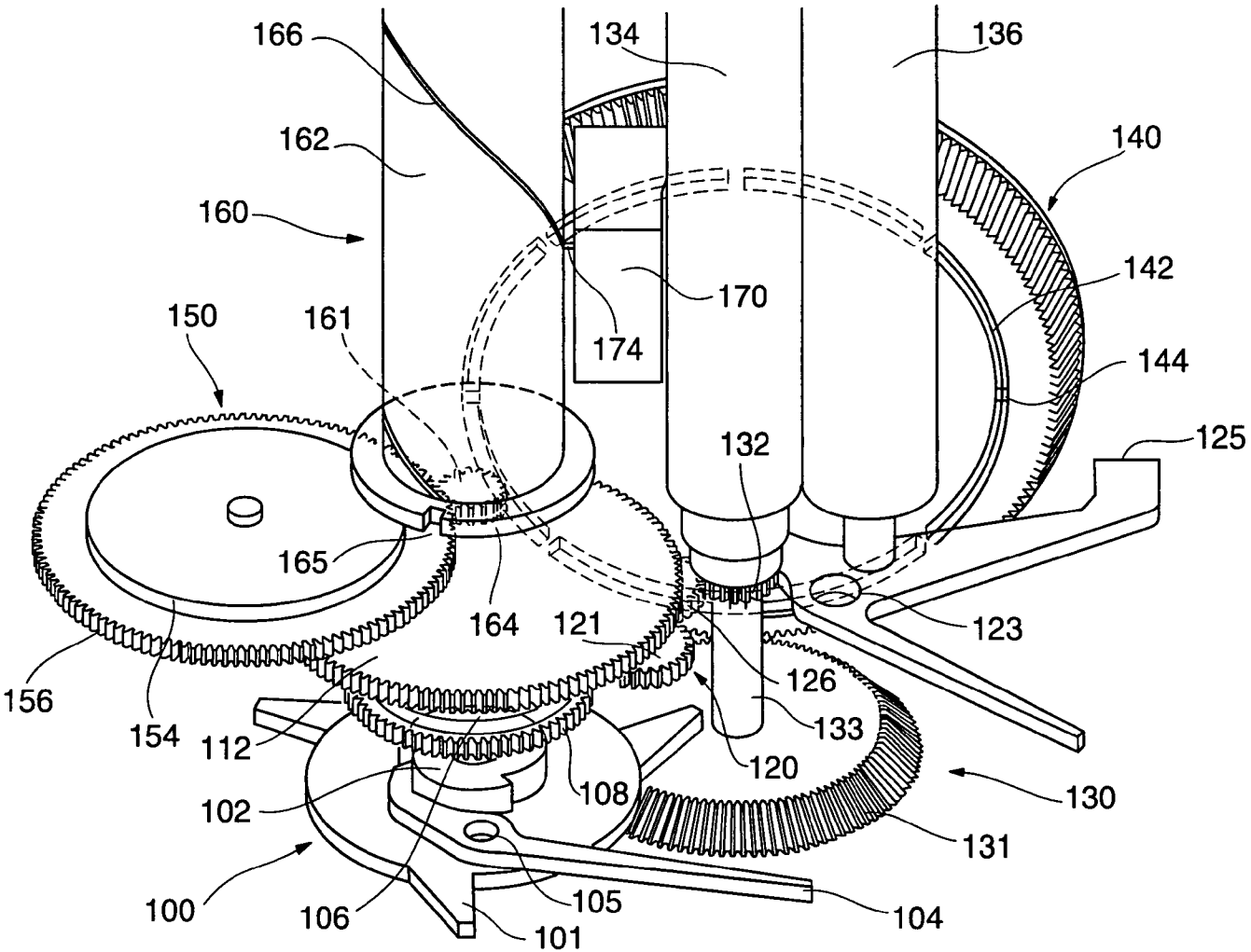
FIG. 7 is a conceptual oblique drawing of the mechanical parts in Embodiment 1.
Figure 8:
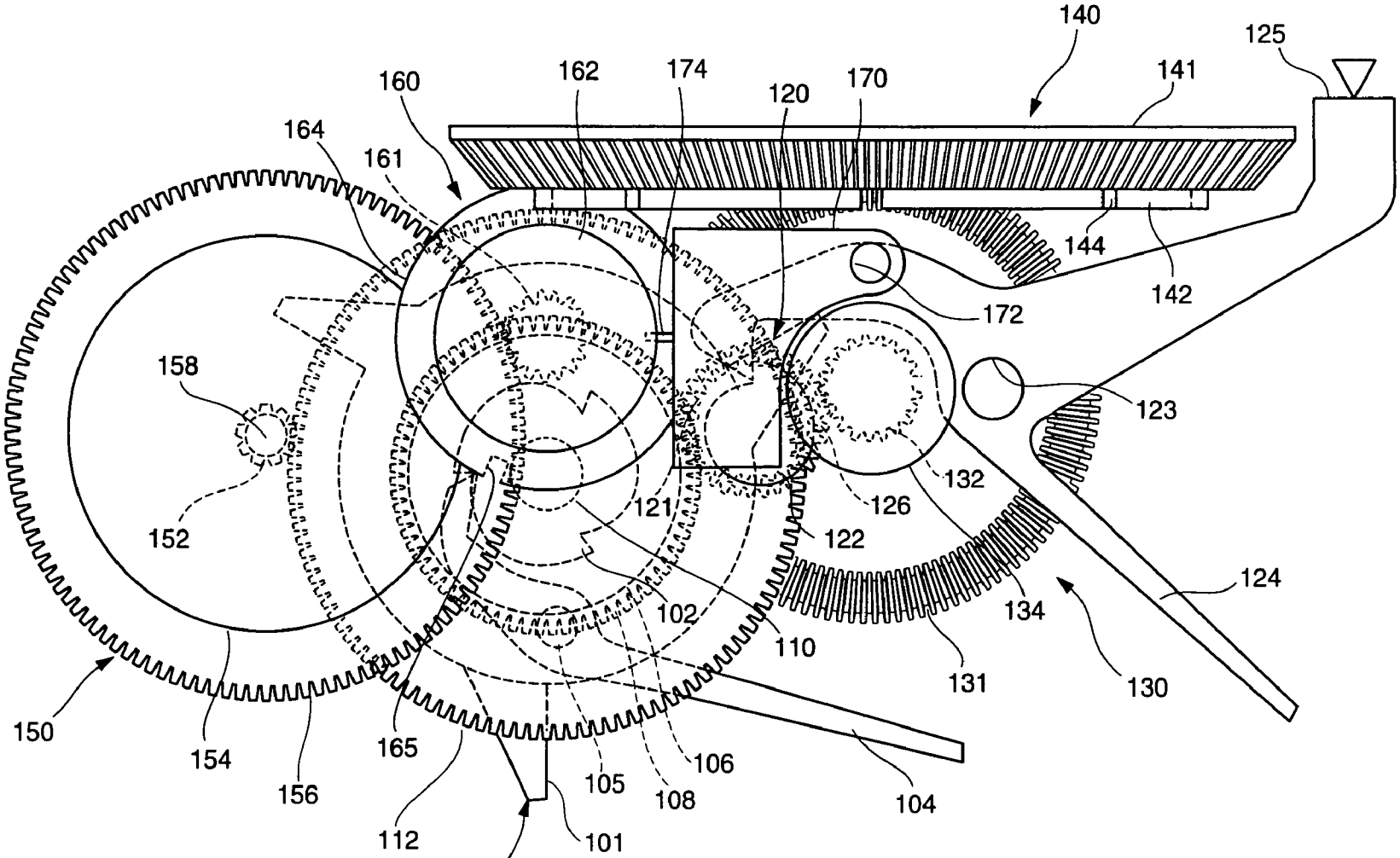
FIG. 8 is a conceptual top view drawing of the mechanical parts in Embodiment 1.

The mechanical energy storage mechanism 100 is provided with the handle 101, a rotation restrictor cam 102, a restrictor lever 104, a barrel 106, a transmission bevel gear 112. As described in FIGS. 1 and 2, the handle 101 is an operating portion that can rotate, being exposed from the body 10 of the printing device 1 to the outside, and which the user can operate. As shown in FIGS. 7 and 8, the rotation restrictor cam 102 is provided with three steps, and the restrictor lever 104, held with a spindle 105, is biased to the direction of the core axis of the rotation restrictor cam 102 by the spring mechanism (not shown). Consequently, the rotation restrictor cam 102 and the restrictor lever 104 together compose a ratchet mechanism, which temporarily fixes and prevents the backspin per every one-third of rotation. Therefore, when the user operates the handle 101, clicking sounds, generated by the restrictor lever 104, sliding down the steps of the rotation restrictor cam 102, per every one-third of rotation is heard. When the user lets go of the handle 101, the handle tries to backspin with a bias generated in a mainspring 107 inside the barrel 106; however, due to the ratchet mechanism, it does not backspin more than one-third of the rotation. The handle 101 and the rotation restrictor cam 102 share the same core of the transmission bevel gear 112 at the barrel axis 110. The mainspring 107 is contained within the barrel 106, and one of its ends is fixed to the barrel axis 110, while its outer end is fixed to the internal wall of the circumference of the barrel 106 in turnup. The barrel 106 can freely rotate the perimeter of the barrel axis 110. A barrel gear 108 is installed in the outer circumference of the barrel 106. In FIG. 8, by turning the handle 101 clockwise when the barrel gear 108 is constraint, the mainspring 107 in the barrel 106 is wound up, and the mechanical energy is stored.

The mechanical energy storage mechanism 150 is provided with a pinion 152, a barrel 154, and a barrel axis 158. The pinion 152 is meshed with the transmission bevel gear 112 of the mechanical energy storage mechanism 100, so that the rotation speed can be increased with a prescribed speed enhancing ratio. The barrel axis 158 is coaxial to the pinion 152, and is provided with the barrel 154 that can freely rotate on its perimeter. Inside the barrel 154, another mainspring 155 is installed. This mainspring 155 is fixed to the barrel axis 158 at its inner end, and its outer end is fixed to the internal wall of the circumference of the barrel 154 in turnup. The barrel gear 156 is installed in the outer circumference of the barrel 154. As described in FIG. 4, the barrel gear 156 is meshed with the speed enhancer, which is the gear train, and its rotation speed is enhanced so as to reach to an appropriate rotation speed, in order to provide the turning force to a rotor of the generator 200.

The head carrying mechanism 160 is provided with a pinion 161, a grooved clutch disk 164, and a guiding roller 162. All of these components are coaxially fixed. The pinion 156 is meshed with the barrel gear 156 of the mechanical energy storage mechanism 150, in a prescribed speed-enhancing ratio. For example, if the print head 170 prints with a width of scanning region of 1.5 cm for one scanning, i.e., during the one-way travel of the print head 170 in the width direction of the sheet S, and if the size of the sheet S is A4 (29.7 cm in length), then the selected ratio is such that while the handle 101 rotates one-third cycle, the guiding roller 162 rotates 19.8 cycles (≈29.7/1.5). The grooved clutch disk 164 is installed on the end of the guiding roller 162, having a flange-shape, and one clutch groove 165 is provided. The guiding roller 162, on which a race 166 is installed in spiral, carries the print head 170. On the race 166, a guide projection 174 of the print head 170 (more precisely, the carriage (a container) that contains the print head 170), which is installed so that it can slide freely in the direction of reciprocation (width direction of the sheet S) on a guiding rail 172, is installed to engage on the race 166. In this configuration, the guide projection 174 is guided along the race 166 in the direction of reciprocation as the guiding roller 162 rotates, and carries the carriage (the print head 170) in the width direction of the sheet S. The race 166 is installed having a form to enable reciprocation; i.e. after the print head 170 is carried to one direction, it is carried again to the opposite direction. In this mechanism, while the guiding roller 162 rotates one cycle, the print head 170 moves from one end of the guiding roller 162 to the other end, and during another rotation, the print head 170 moves from the other end back to the first end. In other words, the print head 170 reciprocates in two rotations of the guiding roller 162.

The intermediate gear 120 is provided with a pinion 121, a rotation restrictor cam 122, and a transmission bevel gear 126. All of these components are coaxially fixed. The pinion 121 is meshed with the barrel gear 108 of the mechanical energy storage mechanism 100, in a prescribed speed-enhancing ratio. The selected speed-enhancing ratio is such that while the handle 101 rotates one-third cycle, the intermediate gear 120 rotates one cycle. As shown in FIG. 8, the rotation restrictor cam 122 is provided to have one step per rotation, and the restrictor lever 124, held with a spindle 123, is biased to the direction of the core axis of the rotation restrictor cam 122 by the spring mechanism (not shown). Consequently, the rotation restrictor cam 122 and the restrictor lever 124 compose the ratchet mechanism, which temporarily fixes and prevents the backspin per every rotation. An electromagnetic switch 340 shown in FIG. 6 pushes the restrictor lever 124 at a working surface of a numeral 125 indicated with a triangle marker. If the working surface 125 is pushed, the restrictor lever 124 is disengaged from the rotation restrictor cam 122, and the rotation restrictor cam 122 starts to rotate.

The sheet carrying mechanism 130 is provided with a pinion 132, a shaft 133, a paper feed roller 134, and a transmission bevel gear 131. All of these components are coaxially fixed. The pinion 132 is meshed with the transmission bevel gear 126 of the intermediate gear 120, in a prescribed speed-enhancing ratio. The speed-enhancing ratio is set that while the handle 101 rotates one-third cycle; the intermediate gear 120 rotates one cycle. For instance, the number of teeth is set so that if the diameter of the paper feed roller 134 is 4 cm and if the size of the sheet S is A4 (29.7 cm in length), then the speed-enhancing ratio is 7.1 times faster at the paper feed roller 134, compared to the rotation speed of the barrel 106. The transmission bevel gear 131 is a taper-shaped toothed wheel that meshes at an angle.

The alternating restriction mechanism 140 is provided with a transmission bevel gear 141 and a grooved clutch disk 142. The transmission bevel gear 141 is a taper-shaped toothed wheel that meshes with the transmission bevel gear 131 of the sheet carrying mechanism 130. The transmission bevel gear 141 is provided with the grooved clutch disk 142 at its circumference. The grooved clutch disk 142 has a shape of a circular flange, like a rim of a dish, and a race 144, provided in plurality, is cut in certain intervals. The relation between the transmission bevel gear 131 and the transmission bevel gear 141 takes a speed enhancement ratio that: while the print head 170 performs one scan with the guiding roller 162 from one end of the sheet S to the other, the grooved clutch disk 142 rotates from one race 144 to the other. The race 144 restricts the rotation of the grooved clutch disk 142 in the alternating restriction mechanism 140, during each time the print head 170 travels one-way.

Each mechanical part mentioned above is fixed on a bottom board (bearing) (not shown) so as to be able to rotate freely, and a pivot hole that is held is provided with an end stone or oil pit, if required. The bottom board is omitted in the drawing in order to simplify it.

Functional Action

Hereafter, with reference to mainly FIG. 6, the operation of the printing device 1 in Embodiment 1 is described.

When storing the mechanical energy, the user turns the handle 101 in the rotation direction allowed by the ratchet mechanism (S1; also refer to BEFORE PRINTING in FIG. 2). In the embodiment, one sheet of the sheet S can be printed with one-third cycle of the handle 101. However, the handle 101 can be wound up consecutively, to the permissible extent of mainsprings 107 and 155, so as to collectively store the mechanical energy.

The more the user turns the handle 101, backspin power is generated at the handle 101 by the mainspring's power to release itself. However, even if the user's hand is taken off, the emission of the mechanical energy is prevented, since the ratchet mechanism by the restrictor lever 104 and the rotation restrictor cam 102 works.

At this point, if the restrictor lever 104 is operated (S3), the restriction is disengaged and the handle 101 backspins, followed by the emission of the mechanical energy stored in the mainsprings 107 and 155 in a burst. In the printing device 1, a function of resetting the energy may be provided by configuring the restrictor lever 104 to be operated either by the input device 313, or directly.

Now, as far as the ratchet mechanism is working, the transmission bevel gear 112 rotates in accordance with the rotation of the barrel axis 110 (S7), the rotation is transmitted to the pinion 152 in the mechanical energy storage mechanism 150 (S40), and the barrel axis 158 rotates while the barrel 154 is constraint (S41). The mainspring 155 is thus wound up, and the mechanical energy is stored at the mechanical energy storage mechanism 150.

Moreover, in the mechanical energy storage mechanism 100, the barrel axis 110 rotates while the movement of the barrel 106 is restricted (S4); hence the mainspring 107 is wound up. Consequently, the mechanical energy is also stored at the mechanical energy storage mechanism 100. At the outer edge of the barrel 106, a strong torque is generated by the mainspring 107's power to release itself (S5). This torque is transmitted to the pinion 121 in the intermediate gear 120 (S10), through the barrel gear 108 (S6), and also to the rotation restrictor cam 122 (S11). Here, the restrictor lever 124 restricts the rotation of the rotation restrictor cam 122, so the rotation restrictor cam 122 does not rotate. This restriction power adversary restricts the torque of the barrel 106, and hence the mainspring 107 is wound up. Similarly, the rotation of the head carrying mechanism 160 is restricted by the alternating restriction mechanism described later; hence the torque of the barrel 154 is restricted and the mainspring 155 is wound up.

That is to say, since the restrictor lever 124 restricts the rotation of the rotation restrictor cam 122, the rotations of every mechanism part, in the direction of releasing the mainsprings 107 and 155, is restricted. Consequently, this restrictor lever 124 is the originating point of print-action.

As mentioned above, the user turns the handle 101 as needed, and stores the mechanical energy to the mechanical energy storage mechanisms 100 and 150. When the user wants to print, the user places the sheet S to the correct position in the sheet feeder 11, operates the input device 313, and instructs the print-start. The electricity is supplied to the control unit 300 from the battery 210. Thus the control unit 300 can correctly interpret the operational information from the input device 313. Thereafter, the mechanical system controlling device 330 outputs the disengaging signal Ss (S63). If the disengaging signal Ss is supplied, the electromagnetic switch 340 activates for a fraction of second, and pushes the working surface 125 of the restrictor lever 124 (S12). If the working surface 125 is pushed, then the restrictor lever 124 moves and the ratchet mechanism is disengaged; thereafter the rotation restrictor cam 122 rotates in accordance with the torque, and the transmission bevel gear 126 starts to rotate (S13).

The rotation of the transmission bevel gear 126 is transmitted to the pinion 132 in the sheet carrying mechanism 130 (S20), and the paper feed roller 134 rotates (S21). In accordance with this rotation, the sheet S is rolled in to the paper feed roller 134 (S22). The carrying direction is indicated in the left drawing in FIG. 2. Along with the rotation of the paper feed roller 134, the transmission bevel gear 131 also rotates (S22).

Figure 10:
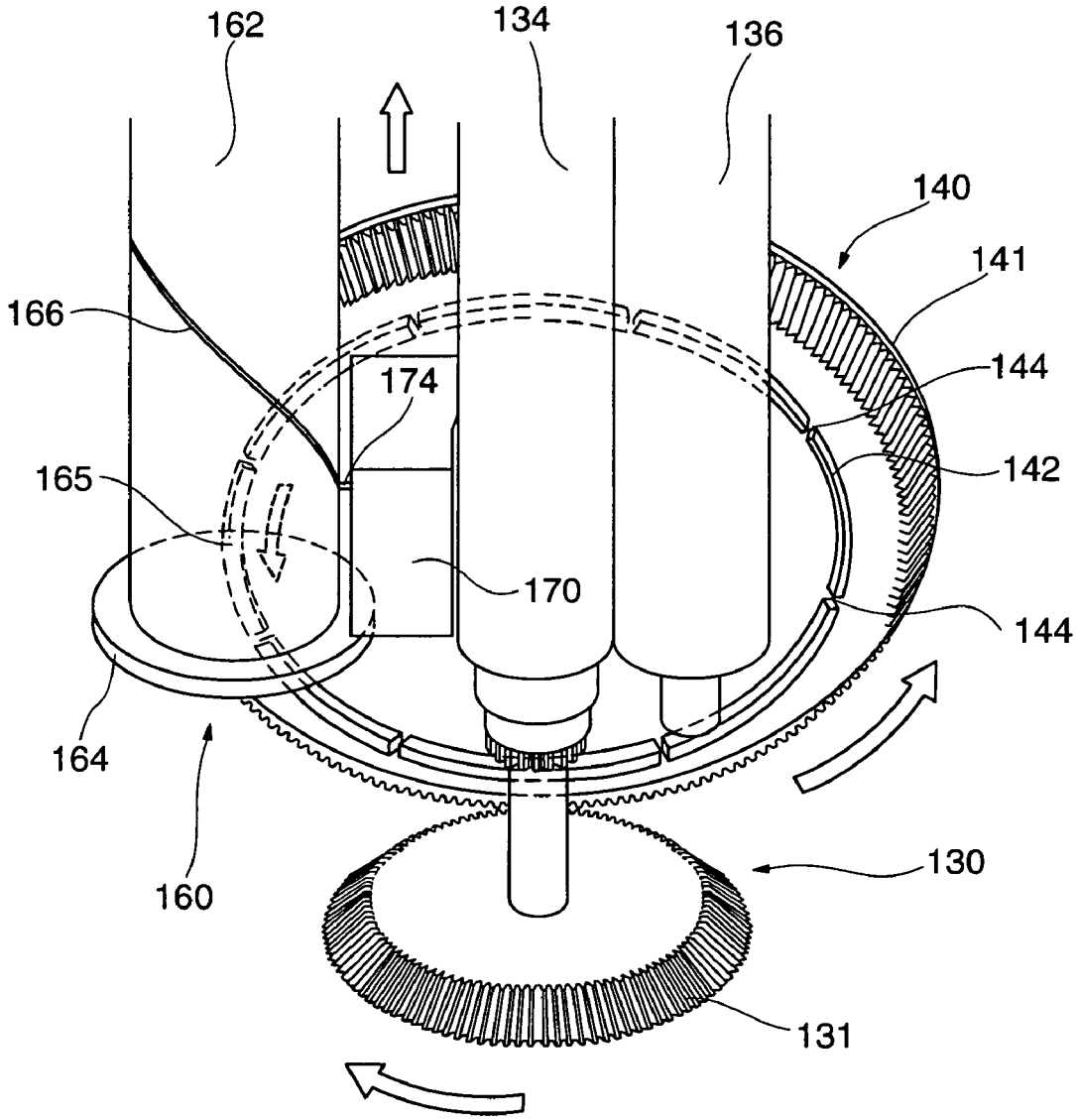
FIG. 10 is an explanatory drawing of an alternating restriction mechanism, and a conceptual oblique drawing showing how a sheet is carried.

As shown in FIG. 10, the rotation of the transmission bevel gear 131 is transmitted to the transmission bevel gear 141 in the alternating restriction mechanism 140 (S30). If the clutch of the transmission bevel gear 141 is unlocked, then the transmission bevel gear 131 and the transmission bevel gear 141 move in directions indicated in the drawing. At this point, the grooved clutch disk 142 is engaged with the clutch groove 165, which is installed at one location of the grooved clutch disk 164 in the head carrying mechanism 160. Consequently, the grooved clutch disk 142 is slowly rotating while sliding inside the clutch groove 165 (S31). On the other hand, as shown in FIG. 10, the torque conveyed from the pinion 161 is working on the guiding roller 162 (S50). However, since the clutch groove 165 of the grooved clutch disk 164 is engaged with the grooved clutch disk 142, both the rotation of the grooved clutch disk 164 and the rotation of the guiding roller 162 are restricted (S51).

Figure 11:
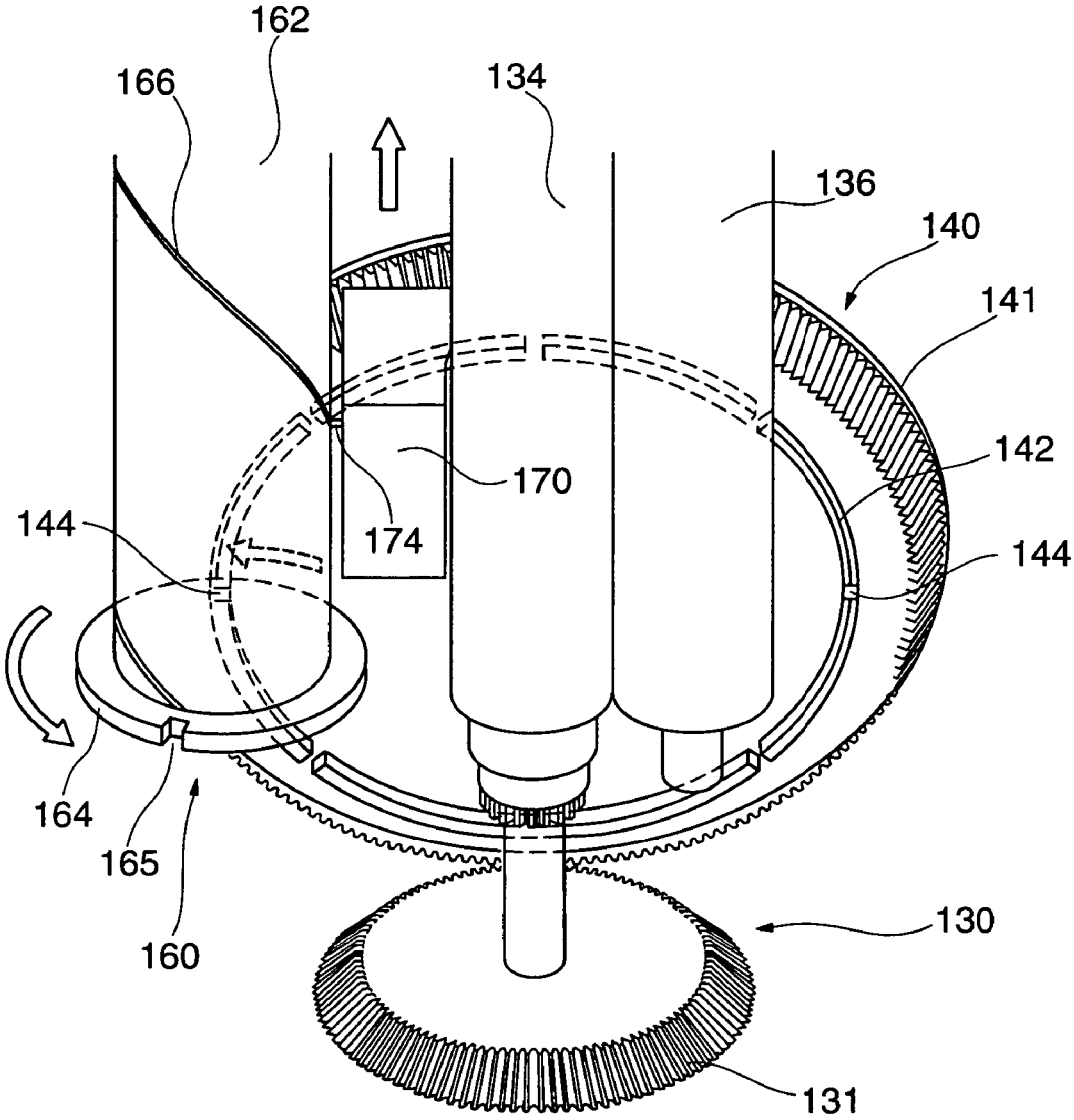
FIG. 11 is an explanatory drawing of the alternating restriction mechanism, and a conceptual oblique drawing showing how a head is carried.
Figure 12A:
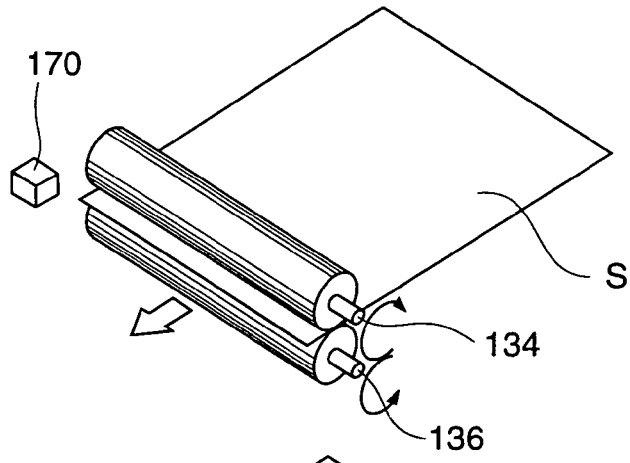
FIG. 12 is a process chart of the carrying of the sheet and the head by the alternating restriction mechanism.
Figure 12B:
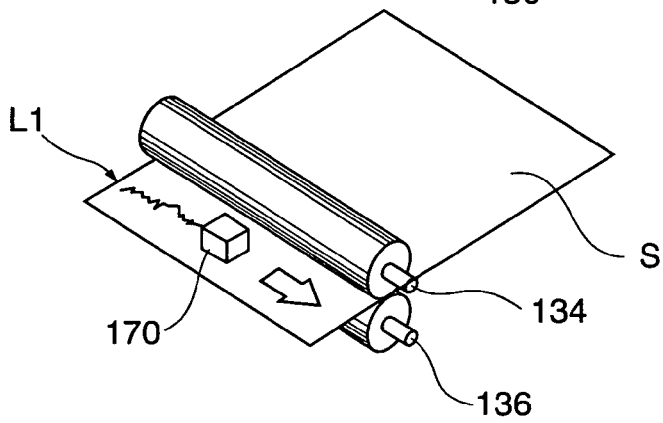
Figure 12C:
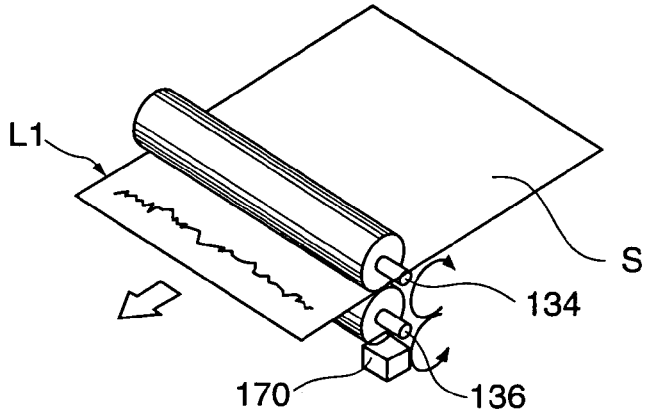
Figure 12D:
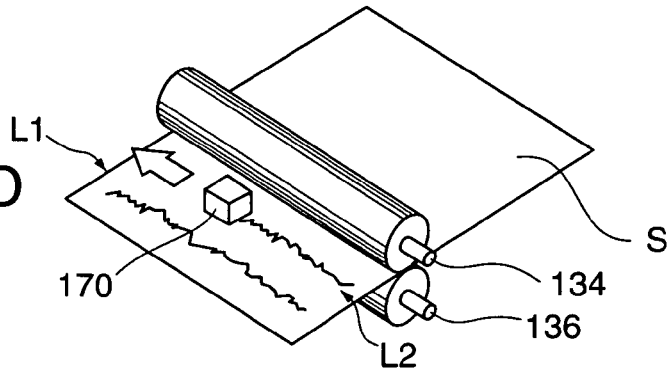

However, as shown in FIG. 11, the moment the race 144 of the grooved clutch disk 142 has reached the grooved clutch disk 164 as the transmission bevel gear 141 future rotates, the constraint of the grooved clutch disk 164 is loosened, and the guiding roller 162 starts to rotate together with the grooved clutch disk 164 in the direction of the arrow indicated in FIG. 11. Once the grooved clutch disk 164 starts to rotate, then it slides inside the race 144 of the grooved clutch disk 142 while being engaged to the grooved clutch disk 142; hence the rotation of the grooved clutch disk 142 is restricted. This restriction continues until the grooved clutch disk 164 rotates one cycle and the clutch groove 165 reaches the grooved clutch disk 142, disengaging the restriction of the grooved clutch disk 142. The guiding roller 162 rotates during this time, as indicated in an arrow in FIG. 11. Hence, with the guide of the race 166, the print head 170 (carriage) moves along the guiding rail 172, together with guide projection 174. While the guiding roller 162 rotates one cycle, the print head 170 is carried from one end of the roller to the other.

With the actions described above, in the sheet carrying mechanism 130, the restriction of carrying the sheet S is disengaged, at the point that the clutch groove 165 reaches the grooved clutch disk 142 when the print head 170 is carried to the edge by the head carrying mechanism 160. The restriction is enabled again at the point that the race 144 reaches the grooved clutch disk 164, after the grooved clutch disk 142 rotates and the sheet S is carried for a prescribed amount. Similarly, in the head carrying mechanism 160, the restriction of carrying the print head 170 in the direction of the sheet width is disengaged, at the point that the race 144 reaches the grooved clutch disk 164 when the sheet S is carried for a prescribed amount by the sheet carrying mechanism 130. The restriction is enabled again at the point that the clutch groove 165 reaches the grooved clutch disk 142, after the grooved clutch disk 164 rotates and the print head 170 is carried the amount of width of the sheet S. As described, by the alternating restriction mechanism 140, the restriction and disengagement are repeated alternately between the sheet carrying mechanism 130 and the head carrying mechanism 160.

In FIG. 12, the relationship between the print head 170 and the sheet feed performed by the above-mentioned functions is shown. Initially, the sheet S is fed for the prescribed amount by the paper feed roller 134 and a paper feed roller 136 (A); thereafter the paper feed roller 134's movement is restricted, and the print head 170's restriction of movement is disengaged, thereby the printing of a first line L1 according to printing data is performed (B). Once the print head 170 is carried to the opposite side, the movement of the print head 170 is restricted, and the restrictions of movement of the paper feed rollers 134 and 136 are disengaged, thereby the sheet S is carried the prescribed amount again (C). Once the sheet S is carried the prescribed amount, the carrying of the sheet is restricted, and the restriction of movement of the print head 170 is disengaged, thereby the printing of a line L2 is performed (D). By repeating several cycles of reciprocations of the print head 170, the printing on one sheet S is completed.

As described above, with the configuration of Embodiment 1, the mechanical energy can be stored by the user's operation of the handle 101 at will. Further, the operation of the restrictor lever 124 enables the carrying of the sheet S utilizing the stored mechanical energy as well as the printing thereon. Therefore the objective of printing can be achieved readily and anywhere.

Moreover, with the configuration of Embodiment 1, the carrying of the sheet and the print head is performed alternately; thus electrical aids for controlling both the line feed and the sheet feed for each line feed are not necessary, enabling to complete the carrying of the sheet and the print head by only the mechanical energy. Therefore the significant electric energy is spent on print-control, allowing power saving, thereby enabling to conduct printing for a long duration in one mechanical energy storage.

Furthermore, the configuration of Embodiment 1 includes the ratchet mechanism, configured to be able to fix itself temporarily with the restrictor levers 124 or 104; hence it is possible to vary the timings of storing the mechanical energy and of printing data by releasing the stored mechanical energy. Hence, at any give time, the user can store the mechanical energy, and as long as the mechanical energy is stored in the mainspring, it is possible to perform printing of as many pages as required, anytime.

Embodiment 2

Embodiment 2, unlike Embodiment 1, relates to a printing device in which its mechanism is configured to carry the sheet bi-directionally, so that the sheet is carried in different directions upon storing and releasing of the mechanical energy.

Figure 13:
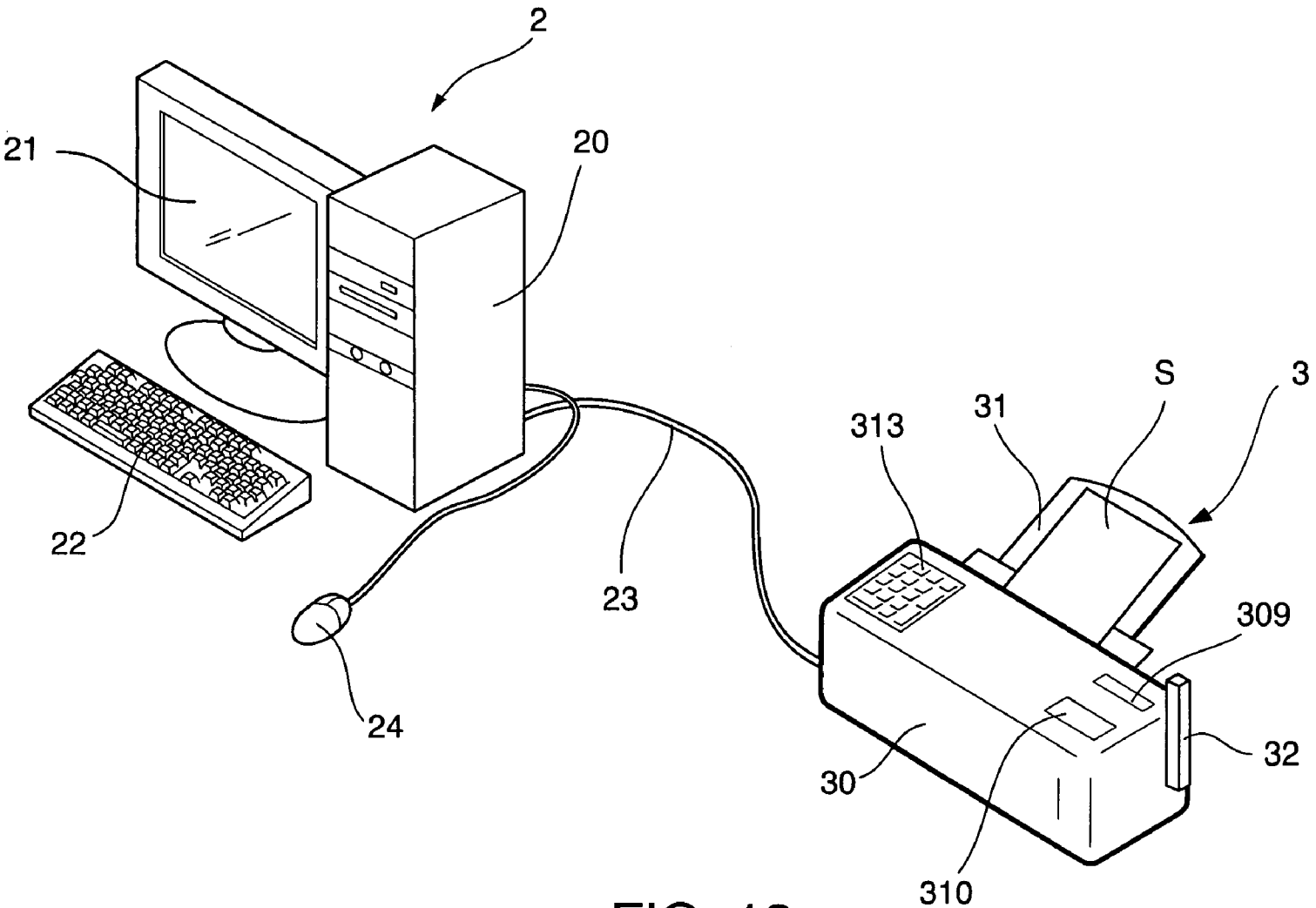
FIG. 13 is a conceptual drawing of a system for a printing device in Embodiment 2.

In FIG. 13, an explanatory drawing of the system configuration including a printing device in embodiment 13 is shown. In FIG. 13, a printing device 3 in Embodiment 2, and a computer device 2 that sends the print-information to the printing device 3, are shown.

The printing device 3, from the outlook, has a body 30 whereon a sheet feeder 31, on which the sheet S is placed, is installed. The difference with Embodiment 1 is that it does not include the vent and the tray for the sheet. Similar to Embodiment 1, the body 30 is provided with: the slot 309 for plugging a removable disk, which is a detachable storage medium, in and out; the display 310 for displaying the prescribed character or a graphic; the connector 311, to which the connection cable 23 is connected, for receiving the print-information being sent from the computer device 2; and the input device 313 for inputting the operational information to the controlling part 300 (refer to FIG. 9). Moreover, on the side surface of the body 30, a lever 32 that is operated by the user for providing the mechanical energy to the mechanical energy storage mechanism in the embodiment of the invention, is installed in a way that it can turn in a certain angle.

The computer device 2 is provided with a configuration as a generic personal computer, and has a similar configuration to that of Embodiment 1.

The block configuration of the printing device 3 is similar to that of Embodiment 1 (FIG. 3). Moreover, the mechanical part has a configuration subject to Embodiment 1 (FIG. 6), except that the directions of carrying the sheet S upon operation and disengagement of the lever 32 are configured to be in reverse. Further, the charging of the battery is configured to be conducted upon releasing of the mainspring. The modifications to those mechanisms are within the scope that can be embodied using the common mechanical techniques.

Figure 14:
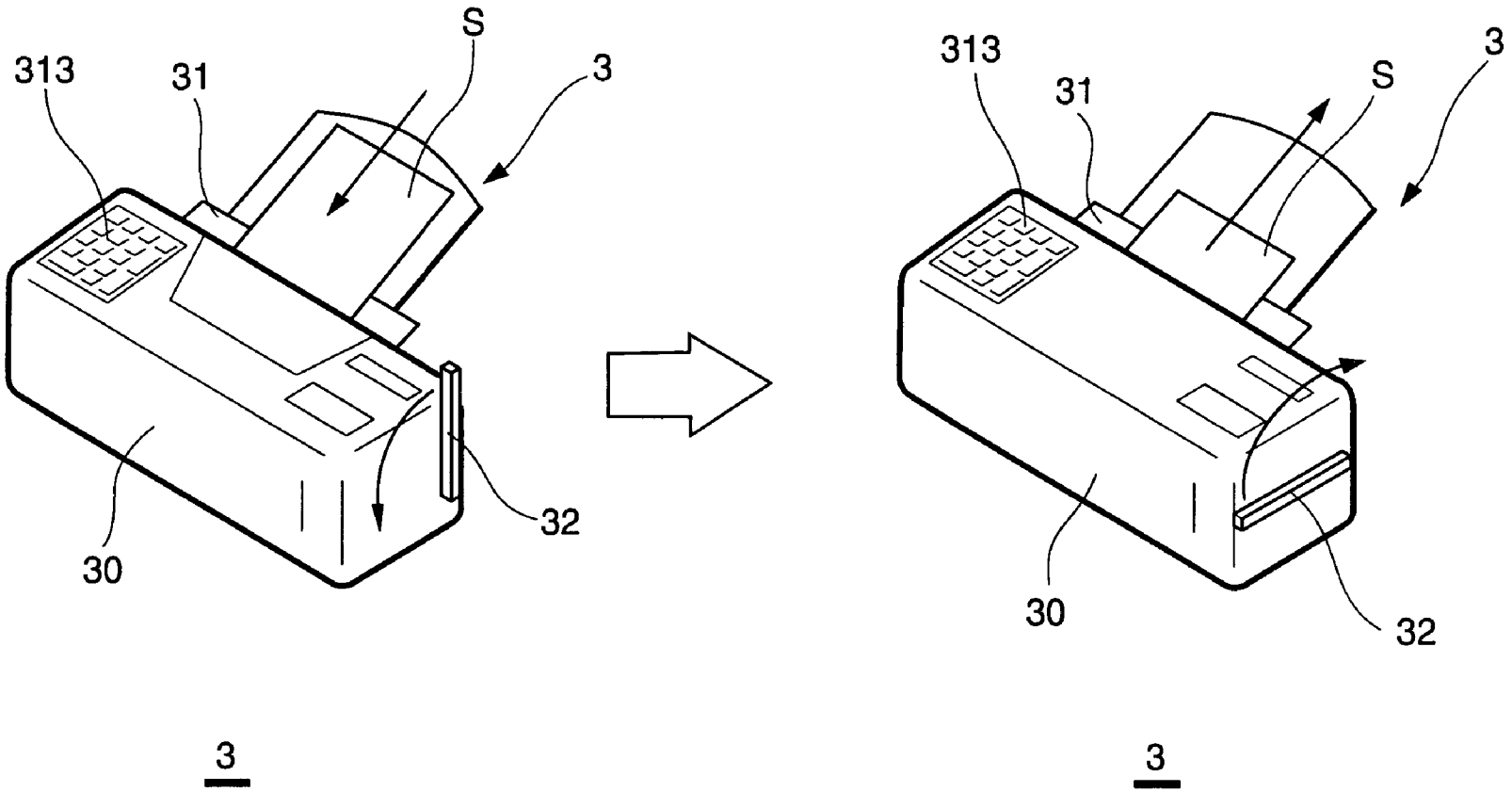
FIG. 14 is an explanatory drawing, showing a direction for carrying of the sheet in the printing device in Embodiment 2.

In FIG. 4, the direction for carrying the sheet S in the printing device 3 in Embodiment 2 is shown. As shown in FIG. 14, in the printing device 3, the user turns the handle 32 to the direction indicated by an arrow prior to the printing, and the power therein is stored as mechanical energy inside the device. The action of turning down the lever 32 is directly conveyed to a paper feed roller, and the sheet S is rolled in approximately to the end. At this point, a restriction is applied by the ratchet mechanism inside the mechanical part.

Upon printing, the user operates the input device 313 and instructs the print-start. Thereafter, the restriction of the ratchet mechanism is disengaged, and the paper feed roller backspins in accordance with the mainspring's power to release itself; thus the sheet S is carried in reverse, in the direction of the arrow. The restriction and disengagement between the sheet carrying and the print head carrying, as described in Embodiment 1, are repeated alternately during the reverse carrying of the sheet S. During the above printing operation, the printing device 3 is configured to convert part of the mechanical energy stored internally into the electric energy, so that the part of the mechanical energy is stored into the battery.

In Embodiment 2, the roll-in and the vent of the sheet S operate in different directions; the printing is performed while the sheet is rolling back. In the case where the size of the sheet is limited, the printing can be conducted with the easily. Therefore, the embodiment suits for, for instance, a toy printer.

Embodiment 3

Embodiment 3 relates to the modified example of a method for providing the mechanical energy to the mechanical energy storage mechanism. The difference with Embodiment 1 is that compressed gas is used for winding the mainspring, while it is performed by operation with handles in Embodiment 1.

Figure 15:
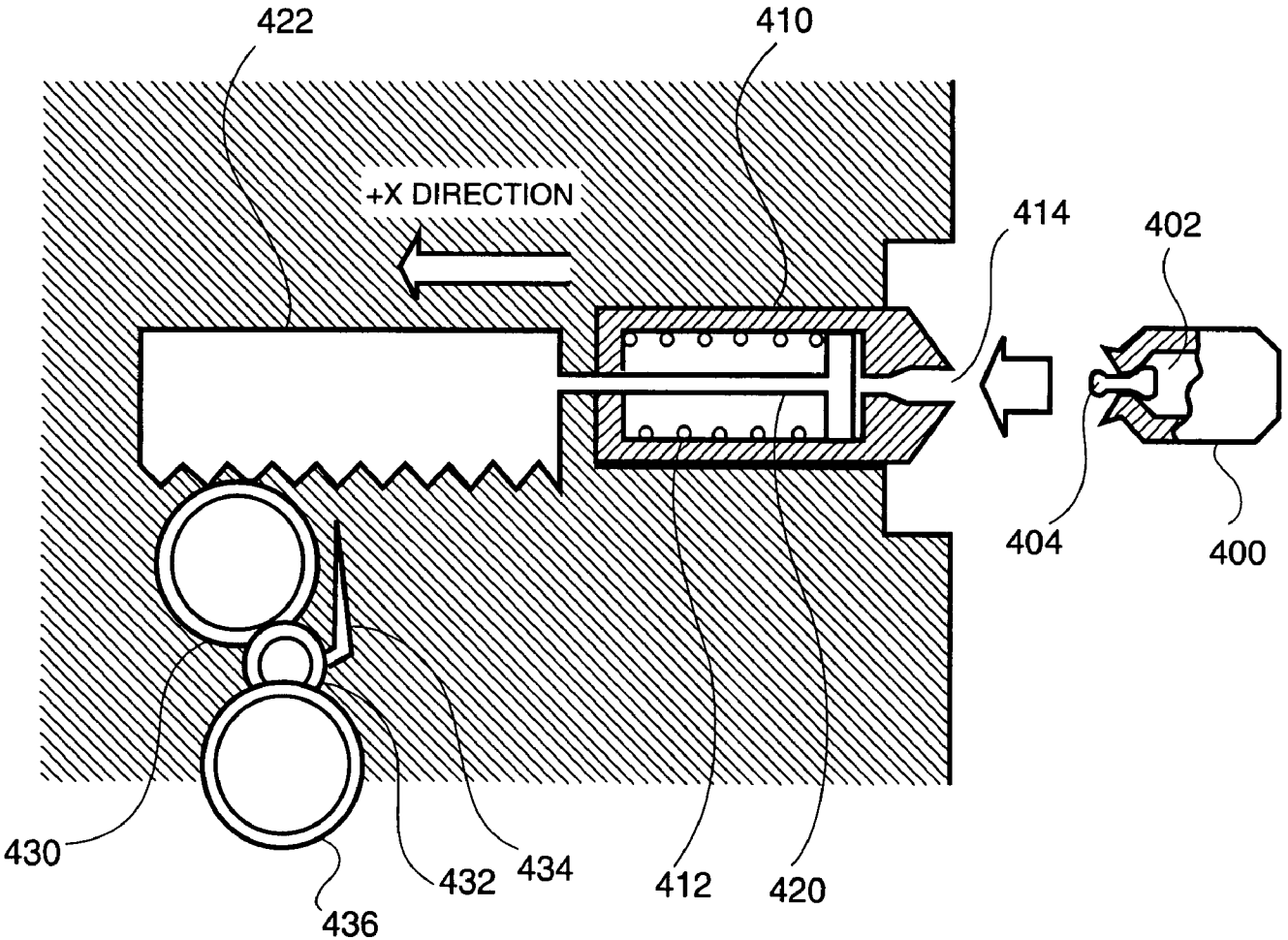
FIG. 15 is a conceptual sectional drawing of a mechanical energy storage mechanism for a printing device in Embodiment 3.

In FIG. 15, a conceptual sectional drawing of the mechanical energy storage mechanism in Embodiment 3, is shown. In FIG. 15, only the mechanical energy storage mechanism is shown and other mechanisms are omitted. The mechanism includes: a cylinder 410, a piston 420 that freely reciprocate by sliding, a rack 422 coupled with the piston 420, a transmission bevel gear 430 that meshes with the rack 422, a rotation restrictor cam 432 and a restrictor lever 434 that compose the ratchet mechanism, a barrel 436 in which the mainspring is contained and wound up in accordance with the rotation of the transmission bevel gear 430.

A spring 412 is installed inside the cylinder 410, and provides a bias to the piston 420 in the direction of −X, from a standard location shown in FIG. 15. The cylinder 410 includes a connection part 414, to which a detachable canister can be plugged in. The canister has a pressure container 400, whereas inside 402 thereof is filled with compressed gas, and is sealed with a check valve 404. Materials for gas are not limited to atmospheric air and may include any type of gas that is inexpensive, safe and can fill with high pressure.

Once the mainspring is wound up, the ratchet mechanism, composed with the rotation restrictor cam 432 and the restrictor lever 434, prevents the mainspring from loosening, while the transmission bevel gear 430 and the rack 422 can move back in the opposite direction (−X direction), regardless of the locked status of the ratchet mechanism, corresponding to the pressure inside the cylinder 410. In other words, after the rack 422 moves in the direction of +X, if the pressure inside the piston 420 is decreased, and the bias of the spring 412 works to the piston 420, then the rack 422 and the piston 420 together can move back in the direction of −X.

In the above-mentioned configuration, by plugging in the canister to the connection part 414 in the cylinder 410, the check valve 404 in the canister is pushed, and the compressed air in the innards 402 is supplied to the interior of the cylinder 410. The piston 420 is pushed against the bias of the spring 412 with the air pressure, and the rack 422 moves in the direction of +X. If the rack 422 moves, then the transmission bevel gear 430 rotates, and the rotation restrictor cam 432 rotates while being restricted by the restrictor lever 434, winding up the mainspring inside the barrel 436. At the point where the compressed air inside the canister is supplied sufficiently, the pressure of the compressed air and the power of the mainspring to release itself counterbalance. By removing the canister, at the stage where the mainspring is not wound up (for instance, the stage where no clicking sound is heard from the ratchet mechanism), the mainspring backspins slightly from the ratchet mechanism's play; however, the restriction is retained by the restrictor lever 434. Consequently, the mechanical energy can be stored, by utilizing the power provided by the pressure of compressed air with the canister to wind up the mainspring.

In case the mainspring can be further wound up, the canister may be removed after use from the connecting part 414, and a new canister, in which other compressed air is filled, can be plugged in again; hence the amount of the mechanical energy stored can be increased. In this mechanical energy storage mechanism, the rack 422 and the piston 420 can move back in the direction of −X, regardless of the status of the wound up mainspring, at the time when the pressure inside the cylinder 410 is decreased; hence the canister can be replaced many times, as long as the mechanical energy can be stored.

As described above, in Embodiment 3, the mechanical energy can be filled easily by only plugging in the canister, without requiring any user operation such as winding up a mainspring; therefore a user-friendly printing device, which includes the mechanical energy conversion mechanism of the invention, can be provided. Moreover, by filling the canister with an easily obtained gas, such as atmospheric air, the canister, which is a source of supply for the mechanical energy, can be provided easily. Therefore, in comparison to conventional electricity-driven printing devices, which require to prepare a supply of spare batteries, it is easier to provide a supply of spare energy.

Embodiment 4

Embodiment 4 relates to the modified example of the mechanical energy storage mechanism itself. The difference with Embodiment 1 is that it uses an internal energy of gas as the mechanical energy, while in Embodiment 1, the mainspring mechanism is used for the mechanical energy storage medium.

Figure 16:
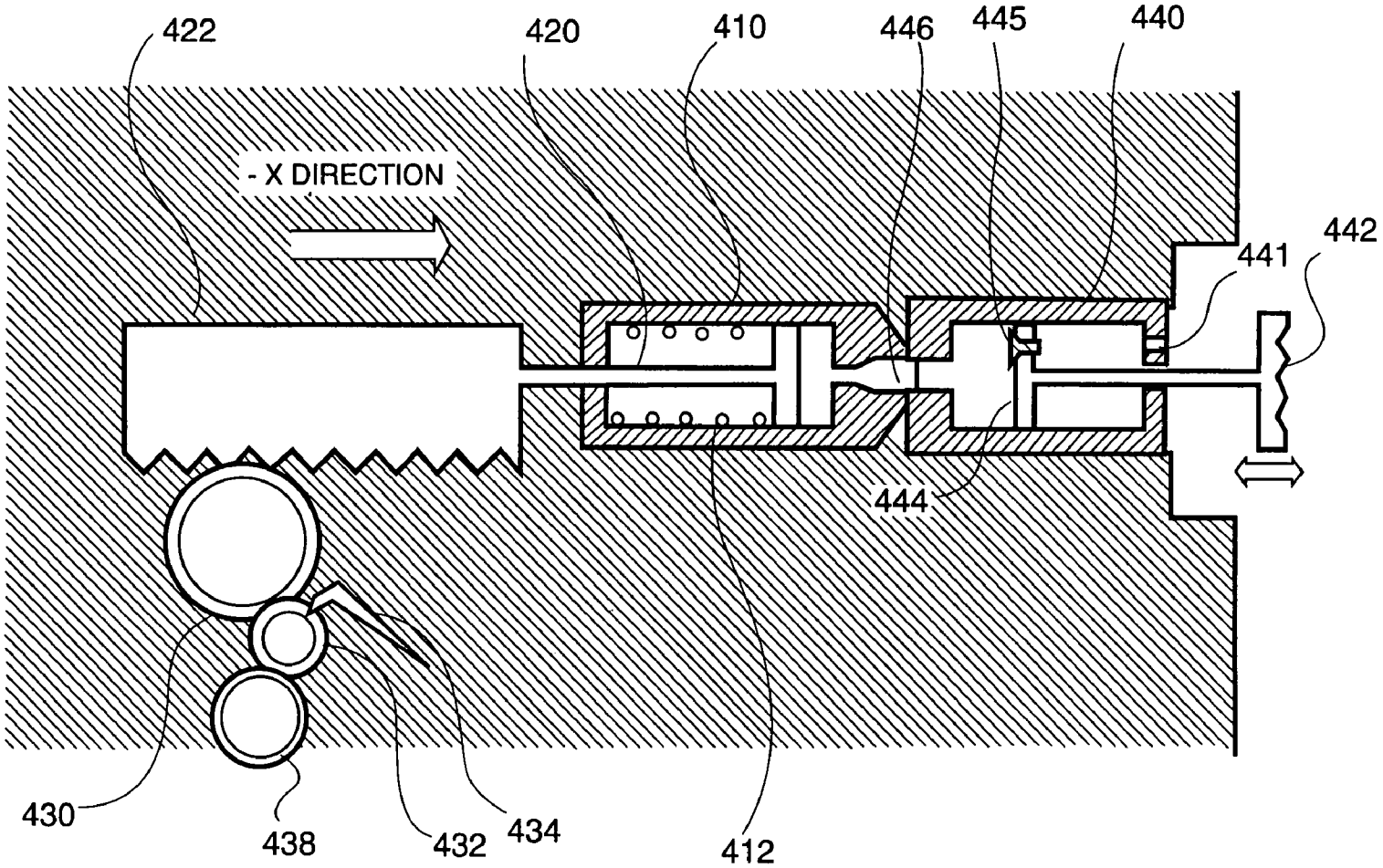
FIG. 16 is a conceptual sectional drawing of the mechanical energy storage mechanism for the printing device in Embodiment 3.

In FIG. 16, a conceptual sectional drawing of the mechanical energy storage mechanism in Embodiment 4 is shown. In FIG. 16, only the mechanical energy storage mechanism is shown and other mechanisms are omitted. In this mechanism, a cylinder 440 is further installed in the upstream of the cylinder 410 of Embodiment 3. The cylinder 440 has a structure of a manual pump for pumping the gas. In other words, a piston 444 that has a knob 442 is provided. A vent hole 441 is installed in the cylinder 440. Further, a check valve 445 is installed in the piston 444. The piston 444 is coupled with the cylinder 410 by a connecting hole 446.

The cylinder 410 includes: the piston 420, the rack 422 coupled with the piston 420, the transmission bevel gear 430 that meshes with the rack 422, the rotation restrictor cam 432 and the restrictor lever 434 that compose the ratchet mechanism, and a transmission bevel gear 438 which transmits the mechanical energy to a subsequent mechanism, in accordance with the rotation of the transmission bevel gear 430. In this Embodiment 4, the spring 412 is installed inside the cylinder 410, slightly providing a bias to the piston 420 in the direction of −X. Moreover, the direction, which the restrictor lever 434 composing the ratchet mechanism restricts, is opposite to that of Embodiment 3. In other words, the piston 420's movement to the direction of +X is restricted.

In the above-mentioned configuration of Embodiment 4, the cylinder 410 works as the mechanical energy storage mechanism. More specifically, in the case where the user grips the knob 442 and reciprocates (or pumps) the piston 444, the check valve 445 opens when the user pulls the piston 444, and the air flows into the cylinder 440. Thereafter when the user pushes the piston 444, the check knob 445 is sealed and the air within the cylinder 440 is compressed and flows into the cylinder 410 through the connecting hole 446. By repeating these actions, the internal pressure of the cylinder 410 increases gradually, and corresponding to the power provided by the air pressure, the piston 420 and the rack 422 try to move in the direction of +X. However, the piston 420 does not move even though the internal pressure of the cylinder 410 increases, since the ratchet mechanism in Embodiment 4 works so as to prevent the rack 422 from moving in the direction of +X. Consequently, the mechanical energy is stored in the cylinder 410 as a form of internal pressure.

In the case of releasing the mechanical energy, the user disengages the restrictor lever 434. If the restrictor lever 434 is disengaged, the piston 420 is pushed in the direction of +X by the power provided by the compressed air in the cylinder 410, and this power is transmitted as a torque of the transmission bevel gear 430 from the rack 422. By utilizing this torque, the energy can be converted into the electric energy, and the operations of the sheet carrying mechanism and the head carrying mechanism can be performed.

When the piston 420 moves in the direction of +X and reaches approximately to the bottom of the cylinder 410, the internal pressure is released and the internal air pressure is set back to the original state. Once the air pressure decreases, the piston 420 returns by itself to the original location with a modest bias of the spring 412. For recharging the mechanical energy, the user reciprocates and pumps with the knob 442.

As described above, in Embodiment 4, printing can be performed anywhere without using an external power source, since the mechanical energy can be charged easily by only pumping the air. Further, the device can be provided with low cost since a mainspring is not used.

Furthermore, as a mechanical energy storing means, mechanisms that uses rubber or springs may also be employed. Springs and rubber can be obtained with low cost; hence they are suitable for toy printers or the like.

What is claimed is:

1. A printing device, comprising:

a mechanical energy storage mechanism configured to store mechanical energy;

an electric energy conversion mechanism configured to convert a part of the mechanical energy into electric energy;

a control unit configured to be operated by the electric energy, the control unit including a print-controlling device that is able to provide a printing data; and a carrying mechanism configured to carry a print head by a remaining part of the mechanical energy, the printing data being provided to the print head.

2. The printing device according to claim 1, further comprising:

an electric energy storage device configured to store the electric energy that is provided form the electric energy conversion mechanism.

3. The printing device according to claim 1, a printing format of the print head being a thermal expansion method.

4. The printing device according to claim 1, a printing format of the print head being a thermosensitive printing method.

5. The printing device according to claim 1, a printing format of the print head being a dot impact method.

6. The printing device according to claim 1, the printing data including a graphic.

7. The printing device according to claim 1, the printing data including a character.

8. The printing device according to claim 1, the control unit further including a mechanical system controlling device configured to provide a control signal to drive the print head.

9. The printing device according to claim 1, the control unit being organized as asynchronous computer that is configured to act asynchronously.

10. A printing device, comprising:

a mechanical energy storage mechanism configured to store a mechanical energy;

an electric energy conversion mechanism configured to convert a part of the mechanical energy into electric energy;

a control unit configured to be operated by the electric energy, the control unit including a mechanical system controlling device configured to provide a control signal; and a carrying mechanism configured to carry a print head by a remaining part of the mechanical energy, the control signal being provided to the print head.

* * * * *